US011186979B2

(12) United States Patent
Hawken et al.

(10) Patent No.: US 11,186,979 B2
(45) Date of Patent: Nov. 30, 2021

(54) MODULE AND ASSEMBLY FOR UNDERGROUND MANAGEMENT OF FLUIDS FOR SHALLOW-DEPTH APPLICATIONS

(71) Applicant: StormTrap LLC, Romeoville, IL (US)

(72) Inventors: Jamie Hawken, Naperville, IL (US); Lynn Boresi, Union, MO (US); Aaron Lowell, Atlanta, GA (US); Kyle McCready, Shorewood, WI (US); Jason Houck, Morris, IL (US); Doug Carncross, Plainfield, IL (US); Tom Heraty, Naperville, IL (US); Dean Gross, Naples, FL (US)

(73) Assignee: StormTrap LLC, Romeoville, IL (US)

( * ) Notice: Subject to any disclaimer, the term of this patent is extended or adjusted under 35 U.S.C. 154(b) by 63 days.

(21) Appl. No.: 16/715,031

(22) Filed: Dec. 16, 2019

(65) Prior Publication Data

US 2020/0190785 A1 Jun. 18, 2020

Related U.S. Application Data

(60) Provisional application No. 62/780,027, filed on Dec. 14, 2018.

(51) Int. Cl.

| | |
|---|---|
| ***E03F 1/00*** | (2006.01) |
| ***B28B 1/14*** | (2006.01) |
| ***B28B 7/10*** | (2006.01) |

(52) U.S. Cl.

CPC ..... *E03F 1/003* (2013.01); *B28B 1/14* (2013.01); *B28B 7/10* (2013.01)

(58) Field of Classification Search

CPC .... B28B 7/10; B28B 7/22; B28B 1/14; E01D 21/00; E03F 1/003

See application file for complete search history.

(56) References Cited

U.S. PATENT DOCUMENTS

| | | |
|---|---|---|
| 862,292 A | 8/1907 | Stoffer |
| 925,019 A | 2/1909 | Parks et al. |

(Continued)

FOREIGN PATENT DOCUMENTS

| | | |
|---|---|---|
| FR | 2927913 | 8/2009 |
| GB | 191216232 | 4/1913 |

(Continued)

OTHER PUBLICATIONS

PCT International Search Report from corresponding PCT application PCT/US2019/066482, dated May 22, 2020.

(Continued)

*Primary Examiner* — Tara Mayo-Pinnock

(74) *Attorney, Agent, or Firm* — Levenfeld Pearlstein, LLC

(57) ABSTRACT

A modular assembly is provided for managing the flow of fluid beneath a ground surface. The assembly can feature a plurality of modules, each having a deck portion and opposing sidewalls extending downward therefrom. The opposing sidewalls can slope outward and away from one another as they extend downward from the deck portion. The modules further comprise a shoulder for supporting a link slab, and to support and separate modules that are stacked during transportation or storage. The sidewalls can define an interior fluid passageway having a flared configuration from top to bottom. The link slab and sidewalls of adjacent modules can define an exterior fluid passageway in fluid communication with a lateral fluid channel. A method is also provided for making a precast concrete module for use in the modular assembly.

20 Claims, 25 Drawing Sheets

(56) References Cited

U.S. PATENT DOCUMENTS

| | | | | |
|---|---|---|---|---|
| 1,028,638 | A | | 6/1912 | Thorsby |
| 1,060,271 | A | | 4/1913 | McBean et al. |
| 1,144,200 | A | | 6/1915 | Hewett |
| 1,184,634 | A | | 5/1916 | Duerrwachter |
| 1,349,166 | A | | 8/1920 | Paff |
| 1,412,616 | A | | 4/1922 | Kammerer et al. |
| 1,453,136 | A | | 4/1923 | Hitchcock |
| 2,095,024 | A | | 10/1937 | Boosey |
| 2,184,137 | A | | 12/1939 | Brewer |
| 2,477,256 | A | | 7/1949 | Kneas |
| 2,708,780 | A | * | 5/1955 | Burkhalter ..... B28B 7/22 249/99 |
| 2,900,083 | A | | 8/1959 | Oliver |
| 3,339,366 | A | | 9/1967 | Gogan et al. |
| 3,570,251 | A | | 3/1971 | Roberts |
| 3,626,823 | A | | 12/1971 | Toth |
| 3,821,869 | A | | 7/1974 | Morgan |
| 3,910,051 | A | | 10/1975 | Komisarek |
| 3,962,839 | A | | 6/1976 | Ickes |
| 4,027,439 | A | | 6/1977 | Willard |
| 4,141,666 | A | | 2/1979 | DeGraff |
| 4,211,504 | A | | 7/1980 | Sivachenko |
| 4,239,416 | A | | 12/1980 | Borca et al. |
| 4,314,775 | A | | 2/1982 | Johnson |
| 4,523,613 | A | | 6/1985 | Fouss et al. |
| 4,595,314 | A | | 6/1986 | Lockwood |
| 4,638,920 | A | | 1/1987 | Goodhues, Jr. |
| 4,687,371 | A | | 8/1987 | Lockwood |
| 4,759,661 | A | | 7/1988 | Nichols et al. |
| 4,797,030 | A | | 1/1989 | Lockwood |
| 4,854,775 | A | | 8/1989 | Lockwood |
| 4,993,872 | A | | 2/1991 | Lockwood |
| 5,134,741 | A | | 8/1992 | Carcassi |
| 5,336,017 | A | | 8/1994 | Nichols |
| 5,401,116 | A | | 3/1995 | Nichols |
| 5,624,204 | A | | 4/1997 | Dorsemaine |
| 5,810,510 | A | | 9/1998 | Urriola |
| 5,836,716 | A | | 11/1998 | Johnson et al. |
| 5,890,838 | A | | 4/1999 | Moore, Jr. et al. |
| 6,004,067 | A | | 12/1999 | Peppard |
| 6,221,445 | B1 | | 4/2001 | Jones |
| 6,277,274 | B1 | | 8/2001 | Coffman |
| 6,322,288 | B1 | | 11/2001 | DiTullo |
| 6,361,248 | B1 | | 3/2002 | Maestro |
| 6,368,017 | B2 | | 4/2002 | Black |
| 6,922,950 | B2 | | 8/2005 | Heierli |
| 6,991,402 | B2 | | 1/2006 | Burkhart |
| 7,160,058 | B2 | | 1/2007 | Burkhart |
| 7,344,335 | B2 | | 3/2008 | Burkhart |
| 8,113,740 | B2 | | 2/2012 | Boulton et al. |
| 8,770,890 | B2 | | 7/2014 | May et al. |
| 9,428,880 | B2 | | 8/2016 | May et al. |
| 9,464,400 | B2 | | 10/2016 | May et al. |
| 9,951,508 | B2 | | 4/2018 | May et al. |
| 10,267,028 | B2 | | 4/2019 | May et al. |
| 2005/0204671 | A1 | | 9/2005 | Heuvel et al. |
| 2006/0034662 | A1 | | 2/2006 | Burkhart |
| 2007/0099477 | A1 | | 5/2007 | Burkhart |
| 2008/0149188 | A1 | | 6/2008 | Zimmerman et al. |
| 2008/0166182 | A1 | | 7/2008 | Smith et al. |
| 2009/0226260 | A1 | | 9/2009 | Boulton et al. |
| 2011/0305512 | A1 | | 12/2011 | DiTullio |
| 2017/0037610 | A1 | | 2/2017 | May et al. |

FOREIGN PATENT DOCUMENTS

| | | | |
|---|---|---|---|
| GB | 1 137 230 | A | 12/1968 |
| GB | 2219813 | A | 12/1989 |
| GB | 2266647 | A | 11/1993 |
| JP | 2-34306 | Y2 | 9/1990 |
| JP | H06-26091 | A | 2/1994 |
| JP | H06-32395 | A | 2/1994 |
| JP | 6-9100 | Y2 | 3/1994 |
| JP | H11-107229 | A | 4/1994 |
| JP | 7-3861 | | 1/1995 |
| JP | H07-1169 | | 1/1995 |
| JP | 8-120746 | | 5/1996 |
| JP | 2504690 | B2 | 6/1996 |
| JP | 2000-213014 | | 8/2000 |
| JP | 2001-107442 | A | 4/2001 |
| WO | 84/03658 | A1 | 9/1984 |

OTHER PUBLICATIONS

PCT Written Opinion of the International Searching Authority from corresponding application PCT/US2019/066482, dated May 22, 2020.

Notification of Transmittal of The International Search Report and The Written Opinion of The International Searching Authority, or The Declaration from corresponding application PCT/US2019/066482, dated May 22, 2020.

City of Chicago Department of Aviation, drawing of project installed at Midway Airport, Oct. 16, 2002, 1 page.

http:www.structuremag.org/archvies/2006/July-2006-C-SP-Double-Tee-Reder-July-06.pdf magazine article on double tee beams, STRUCTURE magazine, Jul. 2006, pp. 28-29.

Advanced Drainage Systems, Inc., "When was the last time a footprint meant so much?", Advertisement, Stormwater, Sep./Oct. 2002, p. 3.

Stormtech, "Profit from the ground up with StormTech's gold chambers", Advertisement, Stormwater, Sep./Oct. 2002, p. 11.

Hydrologic Solutions, "StormChamber The Most Effective BMP!", Advertisement, Stormwater, Sep./Oct. 2002, p. 34.

Invisible Structures, Inc., "Total Stormwater Management", Advertisement, Stormwater, Sep./Oct. 2002, p. 35.

Tilton, Joseph Lynn, "Helping Stormwater Keep its Place", Stormwater, Sep./Oct. 2002, p. 40-41, 44, 46, 48-51.

Contech Construction Products Inc. "Meet NPDES Requirements with CONTECH's Stormwater Treatment Train of Structural BMPs", Advertisement, Stormwater, Sep./Oct. 2002, p. 42-43.

Stormtrap, "Modular Storm Water Detention System", Advertisement, Stormwater, Sep./Oct. 2002, p. 47.

Mar-Mac Manufacturing, Inc., Advertisement, Including photographs and drawings for assembly installed and completed near O'Hare Airport in 2001, 10 pages.

Illinois Department of Transportation, Standard 602101-01, Jan. 1, 1997, 1 page.

Illinois Department of Transportation, Standard 602006, an. 1, 1997, 1 page.

StormTrap drawings prepared by ECOCAST Ltd., for installation in Plainfieid, IL, Aug. 1998, 9 pages.

StormTrap advertisements, StormTrap website, Feb. 2002.

Sep. 30, 2010 PCT Search Report and Written Opinion (International App. No. PCT/US2010/04730).

Dukane Precast Storm Water Management System Completed Project List as of Mar. 2010.

Premiere Dermatology Dukane Drawings w/Double Tees, detention system installed in 2009 at Premier Dermatology in Crest Hill, Illinois, 6 pages.

Summary of Office Action for corresponding MX patent application MX/a/2011/008865, dated Apr. 27, 2015 (5 pgs.).

Supplemental European Search Report for corresponding EP patent application EP10814140.9, dated Jan. 30, 2015 (6 pgs.).

* cited by examiner

MODULE AND ASSEMBLY FOR UNDERGROUND MANAGEMENT OF FLUIDS FOR SHALLOW-DEPTH APPLICATIONS

CROSS-REFERENCE TO RELATED APPLICATIONS

This Application claims priority to U.S. Provisional Patent Application No. 62/780,027, filed Dec. 14, 2018, to Jamie Hawken et al., entitled "Module and Assembly for Underground Management of Fluids for Shallow-Depth Applications," currently pending. The entire disclosure, including the specification and drawings, of the above-referenced application is incorporated herein by reference.

FIELD

The present disclosure generally relates to the underground management of fluids such as storm water runoff and more specifically provides for a precast concrete module and assembly comprised of a plurality of precast concrete modules for subsurface retention and detention of fluids in shallow-depth applications.

BACKGROUND

Commercial development projects in the U.S. and many other developed countries throughout the world are required to address storm water management. As water quality and public health concerns continue to grow, so does the importance of proper storm water control. Commercial land development and urbanization generally increases the number of impervious surfaces, such as, for example, roofs, parking lots, sidewalks, and driveways in a given location, resulting in a greater volume and rate of runoff as well as higher concentrations of pollutants in the runoff.

The U.S. Environmental Protection Agency requires every commercial building project to employ certain best management practices ("BMPs") to control storm water and protect water resources. One such practice comprises a subsurface retention/detention infiltration and storage chamber system that collects, stores, treats, and releases storm water.

Water retention and detention systems generally accommodate storm water runoff at a given site by diverting or storing water, preventing pooling of water at a ground surface, and eliminating or reducing downstream flooding. An underground water retention or detention system generally is utilized when the surface area on a building site is not available to accommodate other types of systems, such as open reservoirs, basins, or ponds. Underground systems do not utilize valuable surface areas as compared to reservoirs, basins, or ponds. They also present fewer public hazards than other systems, such as by avoiding having open, standing water, which would be conducive to mosquito breeding. Underground systems also avoid aesthetic problems commonly associated with some other systems, such as algae and weed growth. Thus, it is beneficial to have an underground system to manage water effectively.

One disadvantage of conventional underground systems is that they must accommodate existing or planned underground facilities, such as utilities and other buried conduits. At the same time, an underground water retention or detention system must be effective in diverting water from the ground surface to another location. Therefore, it would be advantageous to provide a modular underground assembly that has great versatility and adaptability of design in the plan area form it can assume.

Another disadvantage of conventional underground systems, and in particular systems intended for use with large scale developments, is that large storm chambers can be needed in order to be able to adequately handle the volume of storm water needed to be retained or detained in a particular location. This generally results in the need for massive underground systems having considerable height and weight. Such systems usually require appreciable depth below grade which may not be available and/or may require a significant amount of labor to excavate. Such large-scale systems can additionally require considerable material and labor to fabricate, transport, and install. Conventional systems also fail to provide relatively unrestricted water flow throughout the system. It would be preferable instead to provide systems which can permit relatively unconstrained flow throughout their interior in multiple directions.

Depending on the location and application, underground systems must often be able to withstand traffic and earth loads that are applied from above, without being prone to cracking, collapse, or other structural failure. Indeed, it would be advantageous to provide underground systems which accommodate virtually any foreseeable loads applied at the ground surface in addition to the weight of the earth surrounding a given system. Such desired systems would also be preferably constructed in ways that are relatively efficient in terms of the cost, fluid storage volume, and weight of the material used, as well as the ease with which the components of the systems can be shipped, handled, and installed.

Modular underground systems are taught in StormTrap LLC U.S. Pat. Nos. 6,991,402; 7,160,058; and 7,344,335 (the "Burkhart Patents") as well as U.S. Pat. Nos. D617,867, 8,770,890; 9,428,880; 9,464,400; and 9,951,508 (the "May Patents") each of which is incorporated herein by reference in its entirety.

The present disclosure relates to the configuration, production, and methods of use of modules, which are preferably fabricated using precast concrete and are usually installed in longitudinally and laterally aligned configurations to form systems providing underground flow paths for managing the flow of, retaining, and/or detaining water and other fluids. Embodiments disclosed herein are particularly well-suited for large-scale shallow-depth applications by providing a lower profile configuration having a compact height which requires a shallower installation depth while also being able to adequately accommodate a comparable volume of storm water to that of traditional systems which have larger, taller, and heavier components. The module design permits a large amount of internal water flow while minimizing the excavation required during site installation and minimizing the plan area or footprint occupied by each module.

Different forms of underground water retention and/or detention structures have been either proposed or made. Such structures commonly are made of concrete and attempt to provide large spans, which require very thick components. The structures therefore are very massive, which leads to inefficient material usage, more difficult shipping and handling, and consequently, higher costs. Other underground water conveyance structures, such as pipe, box culvert, and bridge culvert have been made of various materials and proposed or constructed for particular uses. However, such other underground structures are designed for other applications or fail to provide the necessary features and above-mentioned desired advantages of the modular systems disclosed herein.

SUMMARY OF THE INVENTION

Disclosed herein is a modular assembly for managing the flow of fluid beneath a ground surface. The assembly can generally comprise a first precast concrete module, at least one shoulder, and a link slab. The first module can comprise a first precast concrete module comprising a first deck portion further comprising a first top deck surface, opposing spaced-apart sidewalls and at least one open end. The opposing sidewalls can be integrally formed with and extend downward from opposing longitudinal sides of the first deck portion. The opposing spaced-apart sidewalls can further slope outward and away from one another as they and extend downward from the first deck portion to respective bottom edges. The at least one shoulder can extend outward from the opposing spaced-apart sidewalls. The link slab can be supported by the at least one shoulder and can comprise a top slab surface being flush with the first top deck surface. In one embodiment, the first deck portion and the opposing spaced-apart sidewalls can define an interior fluid passageway with respect to the first module, and the interior fluid passageway can define a longitudinal flow path. The interior fluid passageway can have a top portion adjacent an underside of the first deck portion and a bottom portion adjacent the respective bottom edges of the opposing sidewalls. The interior fluid passageway can have a flared configuration which widens as it extends from the top portion to the bottom portion. Further, the opposing spaced-apart sidewalls can each comprise at least one lateral opening therethrough which can define a lateral fluid channel, which can define a lateral flow path that is in fluid communication with the interior fluid passageway.

In other exemplary embodiments, the assembly can further comprise at least one seat extending inward from the opposing spaced-apart sidewalls. The at least one lateral opening can be located adjacent the respective bottom edges of the opposing sidewalls. The assembly can comprise a leg integrally formed with and extending downward from the link slab.

In yet another embodiment, the assembly can further comprise a second precast concrete module. The second module can comprise a second deck portion having a second top deck surface and a first sidewall integrally formed with and extending downward from a first longitudinal side of the second deck portion to a bottom edge. The first sidewall of the second module can be laterally adjacent to a first of the opposing spaced-apart sidewalls of the first module. The link slaband the first sidewalls of the first and second modules can define an exterior passageway between the first module and the second module, which can define a second longitudinal flow path. The exterior passageway can be in fluid communication with the lateral fluid passageway and the internal fluid passageway. The link slab can be supported by the second module with the top slab surface being flush with the first and second top deck surface. The exterior fluid passageway can define an exterior height and a top portion adjacent an underside of the link slab and a bottom portion adjacent the respective bottom edges of the first sidewalls of the first and second modules. The exterior fluid passageway can have a tapered configuration which narrows as it extends from the top portion to the bottom portion.

Further, disclosed herein is an assembly for managing the flow of water beneath a ground surface. The assembly can generally comprise a plurality of precast concrete modules, a plurality of link slabs, an inlet port, and an outlet port. The plurality of precast concrete modules can each comprise a deck portion comprising a top deck surface, opposing spaced-apart sidewalls integrally formed with and extending downward from opposing longitudinal side edges of the deck portion to respective bottom edges, at least one open end, and at least one shoulder extending outward from the at least two spaced-apart sidewalls. The opposing spaced-apart sidewalls can slope outward and away from one another as they extend downward from the first deck portion to the respective bottom edges. The plurality of link slabs can each be supported by the at least one shoulder and can comprise a top slab surface. Each module can define interior fluid passageway, which can define a longitudinal flow path. The interior fluid passageway can be defined by an underside of the deck portion and an interior surface of the opposing spaced-apart sidewalls. The interior fluid passageway can have a top portion adjacent the underside of the deck portion and a bottom portion adjacent the respective bottom edges of the opposing sidewalls. The interior fluid passageway can have a flared configuration which widens as it extends from the top portion to the bottom portion. At least some of the plurality of modules can comprise a lateral fluid passageway, which can define a lateral flow path, in fluid commination with the interior fluid passageway. The lateral fluid passageway can be defined by lateral openings extending through the opposing sidewalls of some of the plurality of modules. A first predefined number of the plurality of modules can be arranged side-by-side to form at least one row in a lateral direction. A second predefined number of the plurality of modules can be arranged end-to-end to form at least one column in a longitudinal direction.

In exemplary embodiments, the outlet port can be smaller than the inlet port. The inlet port can be located in the deck portion of at least one of the plurality of modules. The outlet port can be located in a floor defined by the assembly. The assembly can further comprise an outer perimeter comprising a plurality of perimeter precast concrete modules and a perimeter wall. Each perimeter module can comprise a solid external sidewall and an external open end. The perimeter wall can at least partially enclose the external open end of each perimeter module.

Further yet, disclosed herein is a method for making a precast concrete module for use in a modular assembly for managing the flow of water beneath a ground surface. The method can comprise the steps of positioning a bulkhead along a central longitudinal axis defined by a lower portion of a mold, rotating at least two opposing arms comprising at least two distal ends to a first position, supporting a lid on the at least two distal ends, engaging the at least two opposing arms against the lid with a fastening device, introducing concrete into a void defined by the bulkhead and the mold, allowing the concrete to harden, unfastening the fastening device and rotating the at least two opposing arms to a second position, and separating a formed module from the mold. In one embodiment, the bulkhead can comprise at least two side portions, and the at least two side portions can define at least one bulkhead notched section that defines at least one seat void to form at least one seat of the module. In another embodiment, the at least two opposing arms can define at least one arm notched section that defines at least one shoulder void to form at least one shoulder of the module. The at least one arm notched section can be aligned with at least one bulkhead notched section defined by at least two side portions of the bulkhead. The at least two opposing arms can be hingedly secured to the lower portion. Further, the step of engaging the at least two opposing arms against the lid with a fastening device can further comprise step of securing the at least two opposing arms with a plurality of latches. Further yet, the step of unfastening the fastening device and rotating the at least two opposing arms to a second position can further comprise the step of releasing the at least two opposing arms from the plurality of latches.

BRIEF DESCRIPTION OF THE DRAWINGS

In the accompanying drawings, which form a part of the specification and are to be read in conjunction therewith.

DETAILED DESCRIPTION OF THE INVENTION

Figure 1:
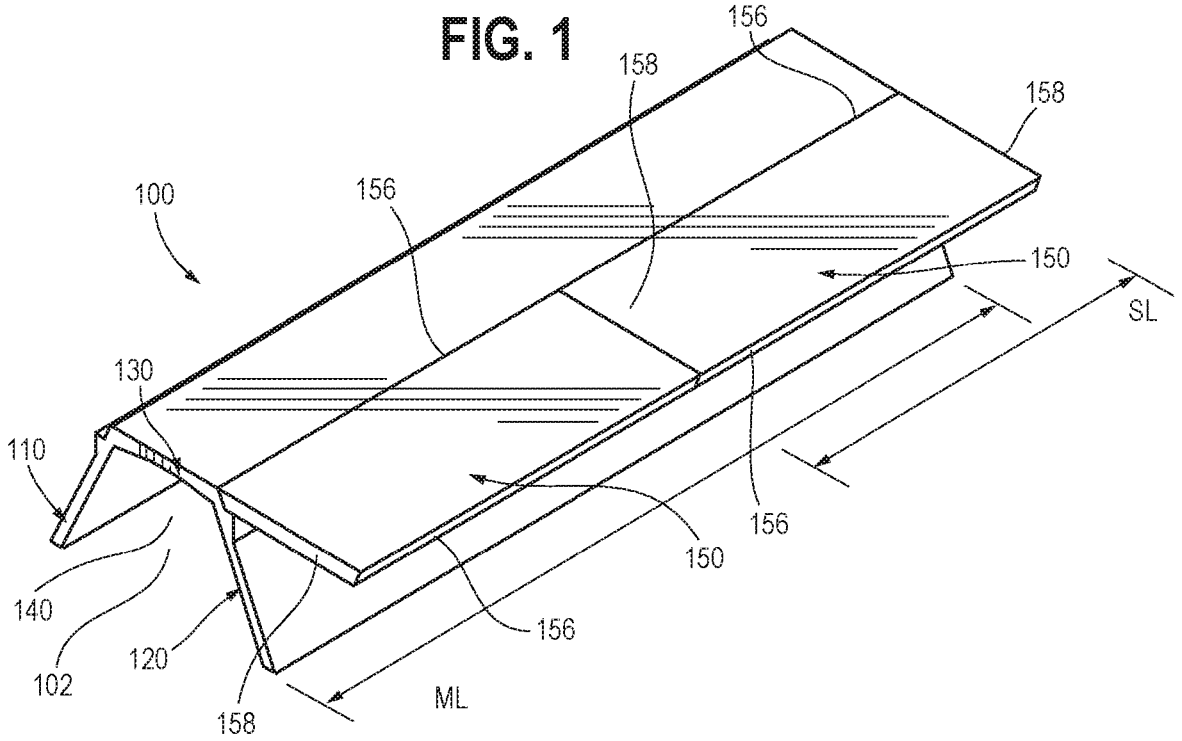
FIG. 1 is a perspective view of a fluid retention/detention module in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures. While the subject invention is susceptible of embodiment in many different forms, there are shown in the drawings, and will be described herein in specific detail, embodiments thereof with the understanding that the present disclosure is to be considered as an exemplification of the principles of the invention and is not intended to limit the invention to the specific embodiments illustrated.

FIGS. 1 through 18 schematically illustrate representative modules and assemblies for underground management of fluids according to exemplary embodiments. Embodiments disclosed herein can comprise a fluid retention/detention module and an assembly or system comprised of a plurality of modules for use in the underground collection of fluids such as storm water runoff. According to exemplary embodiments shown in FIGS. 1 through 18, a plurality of modules can be arranged end-to-end and side-by-side to form an assembly of modules providing a plurality of flow paths, including bidirectional flow paths, in fluid communication with one another. In another embodiment, a plurality of modules or a plurality of assemblies of modules can be arranged vertically in a series of stacked levels of modules or assemblies. The modules and assemblies according to embodiments disclosed herein are capable of providing a low-profile configuration with a compact height for being installed within the ground to capture high-volumes of storm water. Further, as illustrated, the disclosed modules provide great versatility in the configuration of a modular assembly. The modules may be assembled in any customized orientation to suit a plan area or footprint as desired for a particular application and its boundaries. The modular assembly may be configured to accommodate or avoid existing underground obstructions such as utilities, pipelines, storage tanks, wells, and any other formations as desired. Storm water collected by the assembly can be permitted to flow through internal flow paths to be retained for controlled release through either infiltration or discharge though an outlet port. Storm water can also be temporarily detained until it can be manually removed and cast out to an off-site area such as a storm drain, pond, or wetland.

According to exemplary embodiments disclosed herein, the modules can be configured to be preferably positioned in the ground at any desired depth but can be particularly well-suited for applications needing or requiring a shallow installation depth. The module design can permit a large amount of internal water flow while minimizing excavation required during site installation and minimizing the plan area or footprint occupied by each module. The top-most portion of an assembly of modules may be positioned so as to form a ground surface or traffic surface, such as, for example, a parking lot, airport runway, or airport tarmac. Alternatively, the modules may be positioned within the ground, underneath one or more layers of earth. In either case, the modules are sufficient to withstand earth, vehicle, and/or object loads. From the subject disclosure persons of ordinary skill in the art will understand that exemplary modules are suitable for numerous applications and, by way of example but not limitation, may be located under lawns, parkways, parking lots, roadways, airports, railroads, or building floor areas. Accordingly, the modules give ample versatility and adaptability of design for virtually any application while still permitting water flow management and more specifically, water retention or detention.

According to embodiments disclosed herein, each retention/detention module can be made of concrete and can preferably be comprised of a single integral piece of high strength precast concrete. Each module can be fabricated at an off-site facility, according to a method in accordance with the present invention disclosed herein, and transported to the installation site as a fully formed unit. The modules can further be formed with embedded reinforcements which may be steel reinforcing rods, prefabricated steel mesh, or other similar reinforcements. In place of the reinforcing bars or mesh, other forms of reinforcement may be used, such as pre-tensioned or post-tensioned steel strands or metal or plastic fibers or ribbons. Alternatively, the modules may comprise hollow core material which is a precast, prestressed concrete having reinforcing, prestressed strands. Hollow core material has a number of continuous voids along its length and is known in the industry for its added strength. Where a module will be located at or beneath a traffic surface, such as, for example, a parking lot, street, highway, other roadways, or airport traffic surfaces, the module construction will meet American Association of State Transportation and Highway Officials ("AASTHO") standards. Preferably, the construction will be sufficient to withstand an HS20 loading, a known load standard in the industry, although other load standards may be used.

Figure 2:
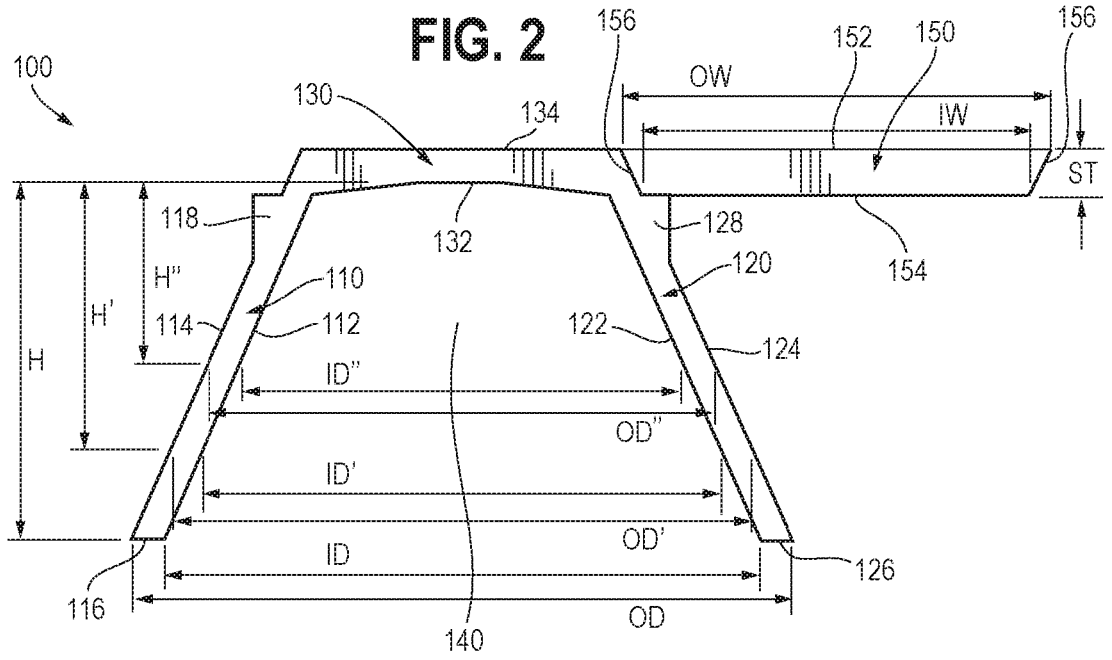
FIG. 2 is a cross-sectional front elevation view of the fluid retention/detention module of FIG. 1.
Figure 3:
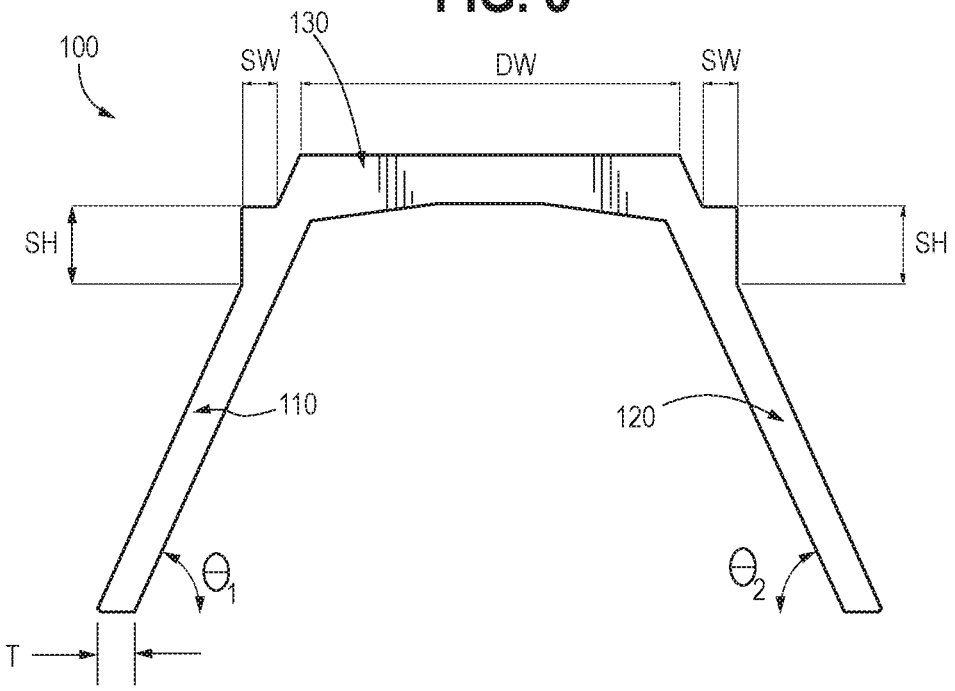
FIG. 3 is a cross-sectional front elevation view of the fluid retention/detention module of FIGS. 1 and 2 shown without a link slab.
Figure 4:
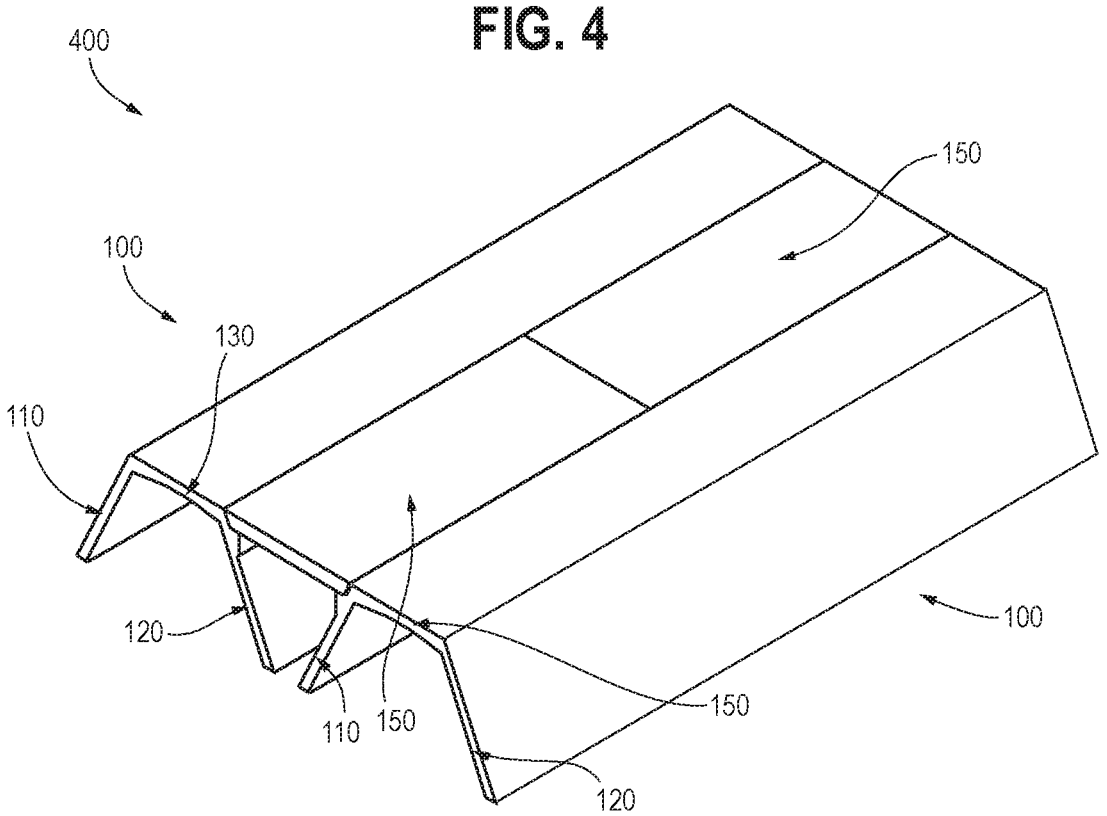
FIG. 4 is a perspective view of a fluid retention/detention assembly in accordance with one embodiment of the present invention.

Turning to FIGS. 1-3, a fluid retention/detention module 100 according to exemplary embodiments of the present invention is shown as generally comprising a first sidewall 110 opposing a second sidewall 120 and a top deck portion 130. The first sidewall 110, the second sidewall 120, and the top deck portion 130 can be coupled together and be integrally formed unit. The module 100 can comprise a first open end 102 and a second open end 104. Each module 100 can define a length ML between the first open end 102 and the second open end (not shown). As best shown in FIG. 1, the sidewalls 110, 120 can be substantially straight along their lengths as they extend between the first open end 102 and the second open end of the module. As best illustrated in FIG. 2, according to exemplary embodiments, the opposing sidewalls 110, 120 can be pitched or set at an angle relative the deck portion 130 such that the sidewalls 110, 120 slope outward and away from one another as they extend downward from the opposing longitudinal sides of the deck portion 130. The first sidewall 110 can comprise an interior surface 112, an exterior surface 114, a bottom edge 116, and in some embodiments, a shoulder 118. The second sidewall 120 can comprise an interior surface 122, an exterior surface 124, a bottom edge 126, and in some embodiments, a shoulder 128. As shown in FIGS. 1-3, the shoulders 118, 128 can be coupled with the exterior surfaces 114, 124 of the sidewalls 110, 120 of the modules 100 and extend outward therefrom. The deck portion 130 can comprise an underside 132 and a top surface 134.

As shown in FIG. 2, each module can further define a height H, an inner demension ID (that is, the space between the interior surfaces 112, 122 of the opposing sidewalls 110, 120), and an outer dimension OD (that is, the distance between the exterior surfaces 114, 124 of the opposing sidewalls 110, 120). The inner dimension ID and the outer dimension OD can vary relative to the height H, such that certain inner dimension ID' and outer dimension OD' correspond with a certain height H' and another inner dimension ID" and outer dimension OD" correspond with another height H", as shown in FIG. 2. The inner dimension ID and outer dimension OD of the modules 100 will generally increase proportionally according to the relative position along each sidewall 110, 120 (that is, generally, a lower position along the sidewall 110, 120 can result in a greater inner dimension ID and outer dimension OD of the module 100 as the angled sidewalls 110, 120 extend farther away from one another at various locations relative to certain heights H, H', H").

The interior surfaces 112, 122 of the opposing sidewalls 110, 120 and the underside 132 of the deck portion 130 can define an interior fluid passageway or channel 140 extending below the deck portion 130 down to the bottom of module 100 (to the bottom ends or edges of the sidewalls 110, 120), which can permit unconstrained flow of fluid therethrough. The interior passageway 140 can extend between opposing open ends 102, 104 of the module 100 forming longitudinal openings at each open end 102, 104. In one embodiment, as shown in FIG. 2, the sloping sidewalls 110, 120 can provide the interior passageway 140 with a flared configuration along its height H from top to bottom—the interior passageway 140 widening towards the bottom such that the inner dimension ID at the bottom portion adjacent the respective bottom edges of the opposing sidewalls is greater than the inner dimension ID at the top (the portion below the underside 132 of the deck portion 130). The underside 132 of the deck portion 130 can define the top of the interior passageway 140. As shown in FIG. 2, the underside 132 can be raised and have a hatched or domed shape in cross section featuring curved or beveled sections along the sides which extend upward to a flat and/or elevated center section.

As best shown in FIG. 3, the opposing interior surfaces 112, 122 and the respective exterior surfaces 114, 124 of the sidewalls 110, 120 can be substantially parallel. As further shown in FIG. 3, the sidewalls 110, 120 can further define a thickness T. In one embodiment, the thickness T of the sidewalls 110, 120 can be on the order of between four and six inches. In a preferred embodiment, the thickness T can be on the order of approximately four inches. The deck portion 130 can define a deck width DW. In one embodiment, deck width DW can be on the order of between two feet and five feet. In a preferred embodiment, the deck width DW can be on the order of approximately three feet, seven inches. The top surface 134 of the deck portion 130 can be substantially horizontal and flat. In one embodiment, the thickness of the deck portion 130 can be uniform. In another embodiment, as shown in FIG. 3, the thickness of the deck portion 130 can vary across its width by having a greater thickness along the sides with the thickness decreasing towards the center portion.

As further best shown in FIG. 3, the first sidewall 110 can define a first sidewall angle $\theta_1$, and the second sidewall 120 can define a second sidewall angle $\theta_2$. In one embodiment, first sidewall angle $\theta_1$ can be on the order of between fifteen degrees and eight-five degrees. In a preferred embodiment, the first sidewall angle $\theta_1$ can be on the order of approximately sixty-six degrees. In another embodiment, second sidewall angle $\theta_2$ can be on the order of between fifteen degrees and eight-five degrees. In a preferred embodiment, the second sidewall angle $\theta_2$ can be on the order of approximately sixty-six degrees. In yet another embodiment, the first sidewall angle $\theta_1$ and the second sidewall angle $\theta_2$ can be equal or approximately equivalent. However, it will be understood that the first sidewall angle $\theta_1$ and the second sidewall angle $\theta_2$ may vary and may not be equal or approximately equivalent.

The shoulders 118, 128 can define a shoulder height SH and a shoulder width SW. In one embodiment, shoulder height SH can be on the order of between two inches and one foot, four inches. In a preferred embodiment, the shoulder height SH can be on the order of approximately nine inches. In another embodiment, shoulder width SW can be on the order of between one inch and one foot. In a preferred embodiment, the shoulder width SW can be on the order of approximately four inches.

As described herein, the retention/detention modules 100 can have varying dimensions and can be provided in a plurality of different sizes according to representative embodiments. Persons of ordinary skill in the art will understand, however, that such exemplary dimensions disclosed herein are not comprehensive of all possible embodiments of the present invention, and that alternate shapes and dimensions are contemplated within the subject invention without limitation. In one embodiment, the length ML of each module 100 can be in the range of ten feet to twenty-five feet or more, and preferably can be on the order of approximately twenty to twenty-three feet long. In one embodiment, the height H can be on the order of between two feet and six feet. In a preferred embodiment, the height H can be on the order of approximately four feet. In another embodiment, the height H' can be on the order of between one foot, six inches and four feet, six inches. In a preferred embodiment, the height H' can be on the order of approximately three feet. In yet another embodiment, the height H" can be on the order of between one foot and three feet. In a preferred embodiment, the height H" can be on the order of approximately two feet. In one embodiment, the inner dimension ID can be on the order of between five feet, nine inches and nine feet. In a preferred embodiment, the inner dimension ID can be on the order of approximately six feet nine inches. In another embodiment, the inner dimension ID' can be on the order of between five feet, three inches and seven feet, six inches. In a preferred embodiment, the inner dimension ID' can be on the order of approximately five feet ten inches. In yet another embodiment, the inner depth ID" can be on the order of between four feet, nine inches and six feet, three inches. In a preferred embodiment, the inner dimension ID" can be on the order of approximately five feet. In one embodiment, the outer dimension OD can be on the order of between five feet, six inches and nine feet, six inches. In a preferred embodiment, the outer dimension OD can be on the order of approximately seven feet, six inches. In another embodiment, the outer dimension OD' can be on the order of between five feet and eight feet. In a preferred embodiment, the outer dimension OD' can be on the order of approximately six feet seven inches. In yet another embodiment, the outer dimension OD" can be on the order of between four feet, six inches and seven feet. In a preferred embodiment, the outer dimension OD" can be on the order of approximately five feet eight inches.

As further shown in FIGS. 1 and 2, the modules 100 may further comprise a panel or link slab 150. Each link slab 150 can define a general rectilinear shape comprising a top surface 152, an underside or bottom surface 154, opposing side edges 156, and opposing end edges 158. As best shown in FIG. 2, in one embodiment, the upwardly facing surface formed on and defined by the shoulders 118, 128 of a module 100 can create a shelf for supporting the bottom surface 154 of the link slab 150. Each link slab 150 may further define an inner width IW, an outer width OW, a slab thickness ST, and a slab length SL. In one embodiment, the inner width IW can be on the order of between three feet, three inches and six feet, nine inches. In a preferred embodiment, the inner width IW can be on the order of approximately four feet, five inches. In one embodiment, the outer width OW can be on the order of between three feet and seven feet. In a preferred embodiment, the outer width OW can be on the order of approximately four feet, ten inches. The link slab 150 can have a uniform thickness ST between the top and bottom surfaces 152, 154. The thickness ST of the link slab 150 can be between four and eight inches, and according to the exemplary embodiments shown in the figures, the preferable thickness can be on the order of six inches. The length SL of the link slab 150 may be on the order of half the length ML of the retention/detention modules 100. This means that when link slabs 150 are used in connection with modules 100, including to cover a space defined between laterally adjacent modules 100, every pair of modules 100 may require the use of approximately two link slabs 150 placed adjacent one another in the longitudinal direction. It will be understood, however, the link slabs 150 can have longer or shorter lengths SL, without limitation.

Figure 5:
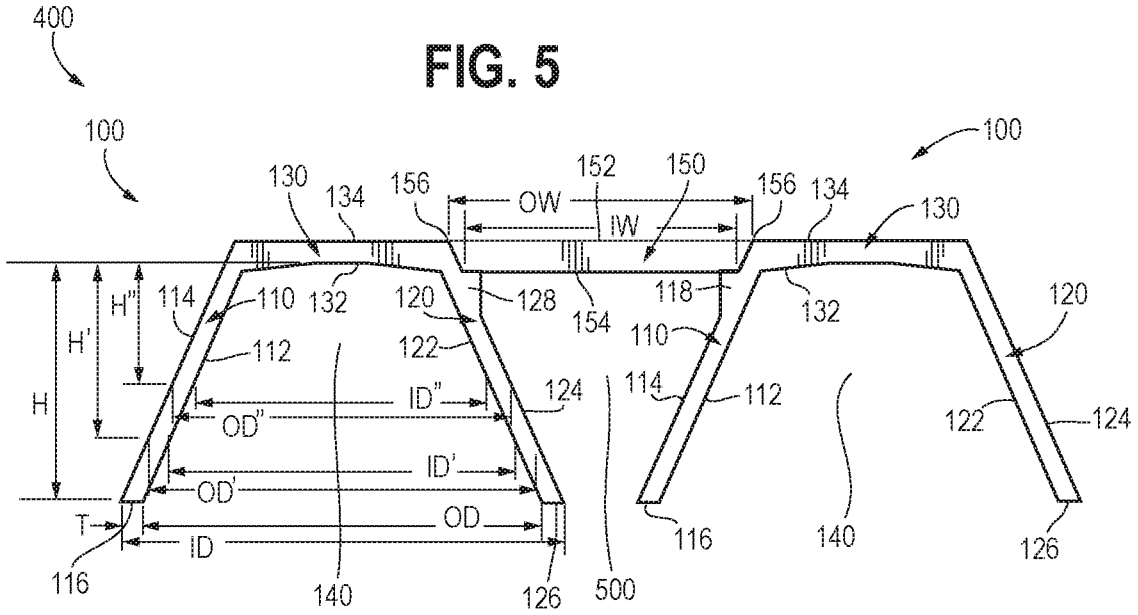
FIG. 5 is a cross-sectional front elevation view of the fluid retention/detention assembly of FIG. 4.

The modules may be arranged in what can be described as rows and columns of various arrangements. As shown in FIGS. 4-15, in one assembly 400, the modules 100 can also be arranged side-by-side to form a row in the lateral direction. The respective sidewalls 120, 110 of adjacent modules 100 can be placed alongside and parallel to each other. More specifically, the bottom edges 126, 116 of each sidewall 120, 110 can be substantially parallel to one another. As best shown in FIG. 5, the modules 100 can be arranged so that there is a space defined between the exterior surfaces 124, 114 of the sidewalls 120, 110, including at or near the bottom edges 126, 116 thereof, of laterally adjacent modules 100, as best shown in FIG. 5. Alternatively, the modules 100 can be arranged so that the bottom edges 126, 116, and exterior surfaces 124, 114 adjacent thereto, of the adjacent sidewalls 120, 110 are flush against one another so that there is no space (or minimal space) therebetween.

As best shown in FIG. 5, the adjacent sidewalls 120, 110 of laterally adjacent modules 100 can angle away from each other as they extend upward from their respective bottom edges 126, 116. Thus, placement of the modules 100 side-by-side for forming a row can result in a space or void between adjacent modules 100 between their respective deck portions 130 (even in those cases where the bottom edges 126, 116 of the sidewalls 120, 110 of adjacent modules 100 are placed flush against one another). As shown in FIG. 5, the space between laterally adjacent modules 100 can be generally flared along its height from bottom to top (or tapered when viewed from top to bottom) to define a generally triangular-shaped exterior passageway 500 (that is, the space between the exterior surfaces 124, 114 of the sidewalls 120, 110 of adjacent modules 100), which can permit unconstrained flow of fluid therethrough. The exterior passageway 500 can be generally parallel to the interior passageway 140 of the module 100 and extend between opposing open ends 102, 104 of the module 100. As shown schematically in FIG. 5, exterior passageway 500 according to exemplary embodiments can narrow as it extends from the top portion to the bottom portion.

According to exemplary embodiments shown in FIGS. 4-10, a link slab 150 can be placed between laterally adjacent modules 100. As shown in FIG. 5, the bottom surface or underside 154 of the link slab 150 can define the top of the exterior passageway 500. The side edges 156 of the link slab 150 can be positioned against the exterior surfaces 124, 114 of the respective angled sidewalls 120, 110 of adjacent modules 100. The side edges 156 can be beveled at an angle corresponding to the angle of the sidewalls 120, 110 so that the side edges 156 of the link slab 150 can be positioned flush against the angled sidewalls 120, 110. In one embodiment, the bevel of the side edges 156 of the link slab 150 can be formed when the outer width OW of the link slab 150 is greater inner width IW of the link slab 150. The link slab 150 can be supported between laterally adjacent modules 100 in a manner such that the top surface 152 of the link slab 150 is flush with the top surfaces 134 of the deck portions 130 of the modules 100 to form a generally level platform. As shown in FIG. 5, the outer width OW of the link slab 150 along the top surface 152 can correspond to the distance between the side edges of the deck portions 150 of adjacent modules 100.

Figure 6:
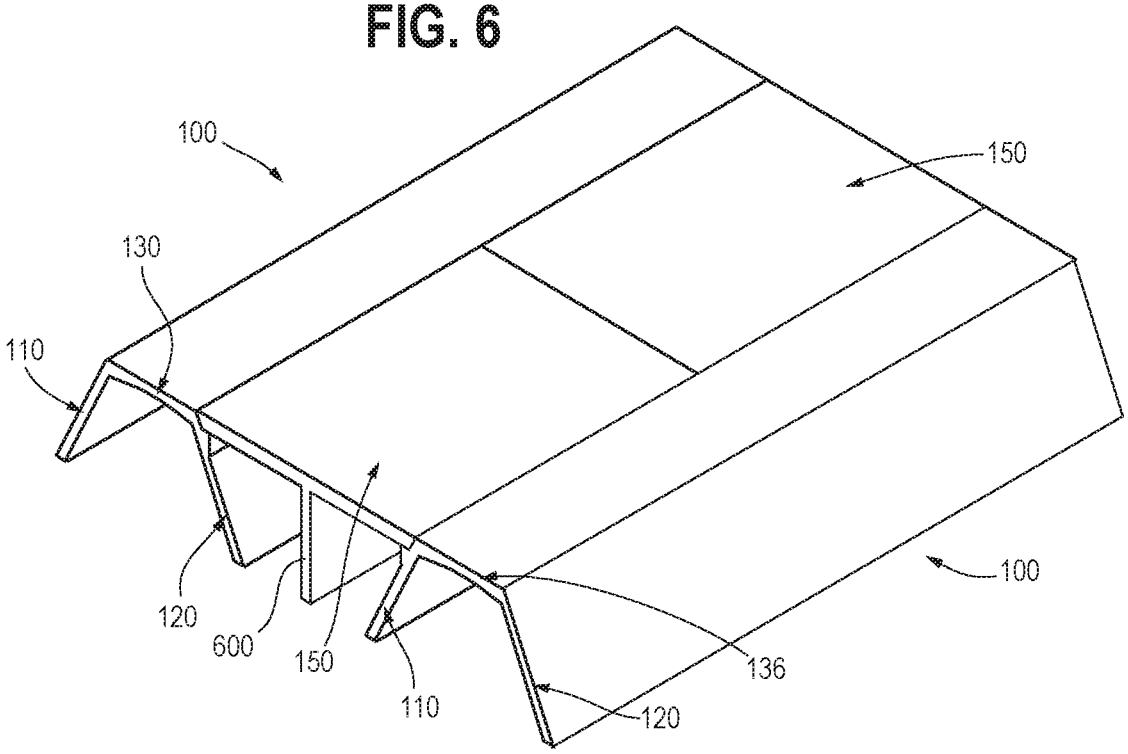
FIG. 6 is a perspective view of another fluid retention/detention assembly in accordance with one embodiment of the present invention.
Figure 7:
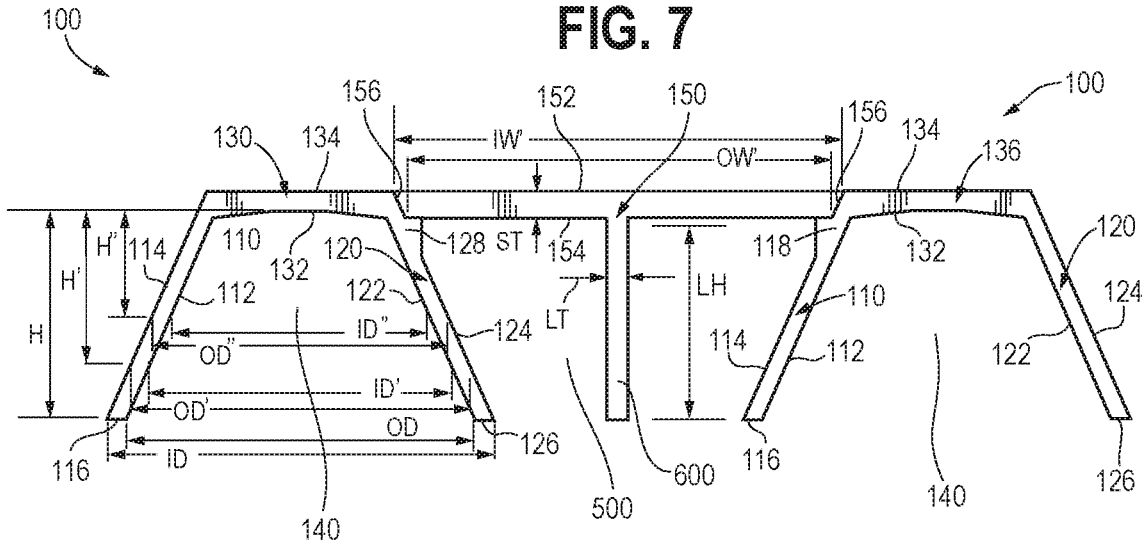
FIG. 7 is a cross-sectional front elevation view of the fluid retention/detention assembly of FIG. 6.

In one embodiment, as shown in FIGS. 6 and 7, the link slab 150 can have a vertical support leg 600 integrally formed with and extending downwardly from the bottom surface 154 of the link slab 150. Each leg 600 can generally define a thickness LT and a height LH. The legs 600 can be spaced inward from the side edges 156. As best shown in FIG. 7, the vertical support legs 600 can be substantially centered along the general width of the link slab 150, which can give the link slab 150 a generally T-shaped in cross section. According to certain embodiments, when the link slab 150 is placed between adjacent modules 100 the legs 600 can rest against a lower portion of the angled sidewalls 110, 120 to provide additional support for the link slab 150. In one embodiment, the leg height LH can generally correspond with the height H of the module 100, so that each leg 600 can extend down to rest on a surface (not shown) between or ground (not shown) common to laterally adjacent modules 100 while also allow for the top surface 152 of the link slab 150 to be flush with the top surface 134 of the deck portions 130 of the adjacent modules 100 to form a generally level platform. In another embodiment, the leg thickness LT can be on the order of between three and six inches, and according to the exemplary embodiments shown in the figures, the thickness LT can preferably be on the order of four inches.

Figure 8:
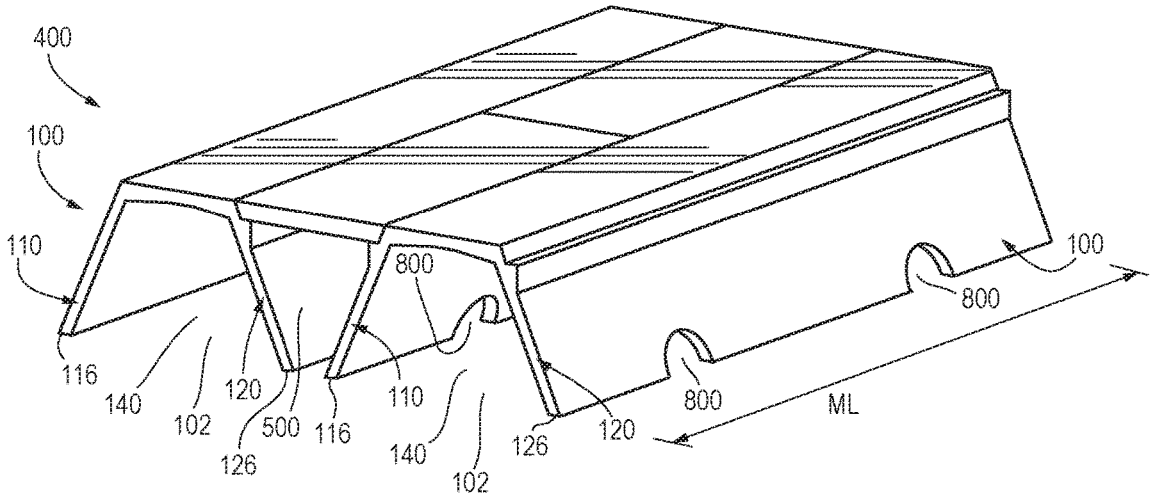
FIG. 8 is a perspective view of a fluid retention/detention assembly in accordance with one embodiment of the present invention.
Figure 9:
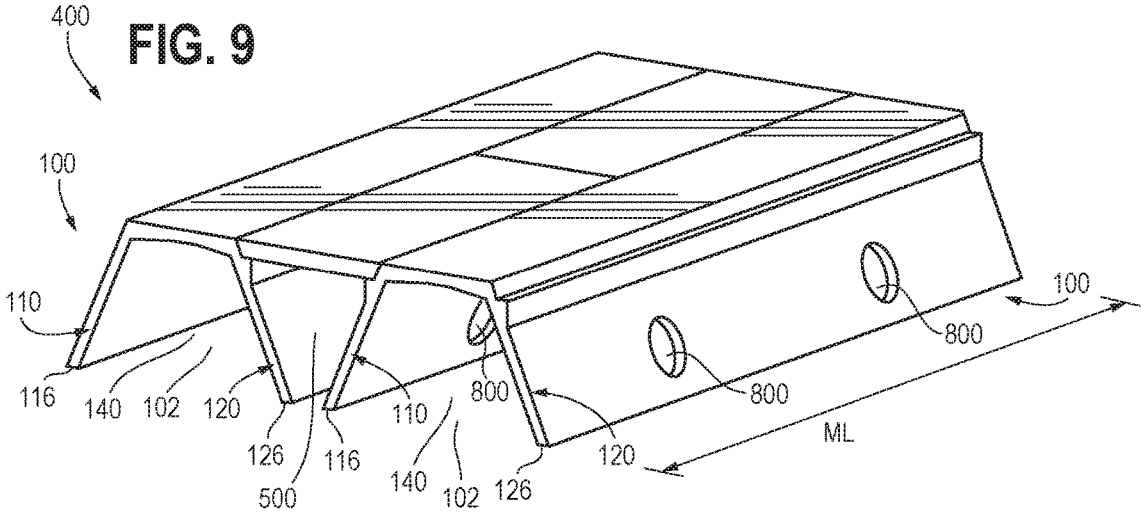
FIG. 9 is a perspective view of a fluid retention/detention assembly in accordance with one embodiment of the present invention.
Figure 10:
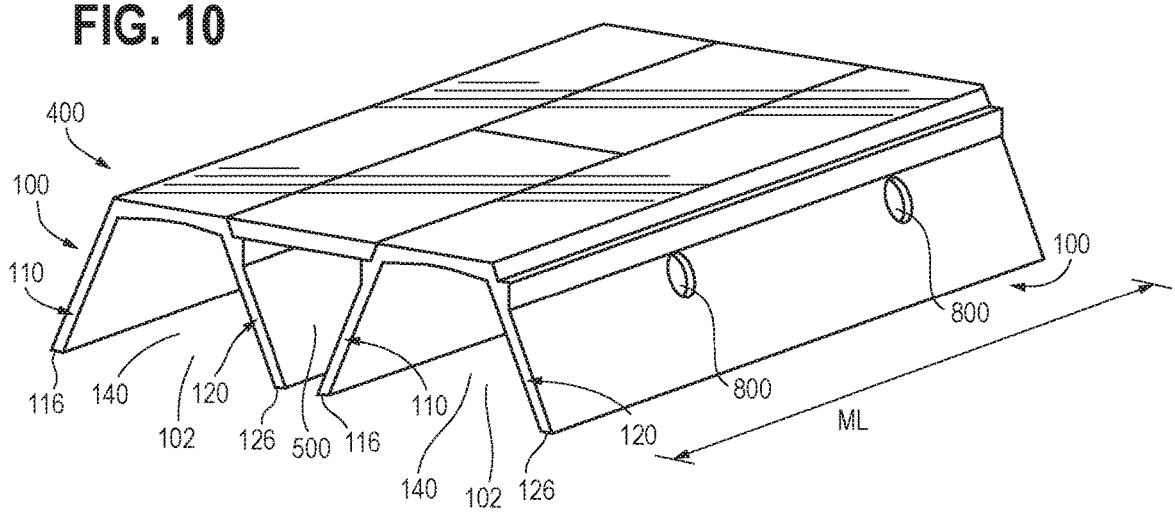
FIG. 10 is a perspective view of a fluid retention/detention assembly in accordance with one embodiment of the present invention.

According to embodiments shown in FIGS. 8-10, the sidewalls 110, 120 of the retention/detention modules 100 can define lateral openings 800. In one embodiment, the lateral openings 800 can be located adjacent the bottom edges 116, 126 of the sidewalls 110, 120, as shown in FIG. 8. In another embodiment, the lateral openings 800 can be located at some point elevated from the bottom edges 116, 126, as shown in FIGS. 9 and 10. However, it will be understood that lateral openings 800 can be located at any point on the sidewalls 110, 120, including in any combination discussed herein. Although FIGS. 8-10 show the lateral openings 800 as being generally circular (or semi-circular) and having a generally smaller effective diameter than the longitudinal openings at the open ends 102, 104 of the retention/detention modules 100, it will be understood that the lateral openings 800 can have alternate shapes and sizes without limitation and can further be substantially the same size as such longitudinal openings.

In one embodiment, where the lateral openings 800 are located adjacent the bottom edges 116, 126 of the sidewalls 110, 120, the common passageways can create lateral fluid channels permitting substantially unobstructed fluid flow laterally through an assembly 400 where at least one interior passageway 140 and/or an exterior passageway 500 are in fluid communication with one another, including via the lateral openings 800. Such lateral fluid flow, in addition to the longitudinal flow of fluid through the interior passageway 140 and/or exterior passageway 500, can create an advantageous bidirectional fluid flow through the assembly 400. Where the lateral openings 800 are located at some point elevated above the bottom edges 116, 126, the fluid within the interior passageway 140 and/or the exterior passageway 500 can be generally restrained from lateral flow, such that the fluid must rise to at least the bottom edge of the lateral openings 800 in order to flow in a lateral direction through the assembly 400. In such embodiments where the common passageways create lateral fluid channels, fluid flowing within the interior passageway 140 of the module 100 can permitted to pass through the lateral openings 800 into the exterior passageway 500 between adjacent modules 100 only once the fluid has reached a certain volume or flow rate. In other embodiments where two laterally adjacent modules 100 comprise sidewalls 120, 110 with lateral openings 800, fluid flowing within the interior passageway 140 of one module 100 can be permitted to pass through the lateral openings 800 of that module 100, into the exterior passageway 500, and through the lateral openings 800 of the other module 100 and into the interior passageway 140 thereof. In another embodiment, the respective lateral openings 800 of adjacent modules 100 can be vertically offset or tiered relative to each other. When such corresponding lateral openings 800 are tiered, the assembly 400 may allow for bidirectional flow only when the passageways 140, 500 have reached a certain, predefined volume or flow rate. Such restriction on the bidirectional flow can be advantageous to control the flow and storage through and within the assembly 400 for purposes of meeting certain retention, detention, and discharges standards.

In one embodiment, as best shown in FIGS. 8 and 9, the position of a first lateral opening 800 defined in a first sidewall 110 of a module 100 can generally align with the position of a second lateral opening 800 defined in a second sidewall 120 of the module 100, to effectively define a common passageway that passes through the interior passageway 140. In another embodiment, the lateral openings 800 defined in the sidewalls 110, 120 of an individual module 100 can be offset from one another along the length ML of the module 100. In yet another embodiment, the position of lateral openings 800 of a respective module 100 can generally align with the position of lateral openings 800 of other modules 100, that is also comprising an assembly 400, to effectively define a common passageway throughout the assembly 400, which can also pass through the exterior passageway 500.

In an embodiment where the lateral openings 800 of laterally adjacent modules 100 generally align to define a common passageway of the assembly 400, the lateral openings 800 can form a continuous lateral fluid channel between the modules 100. In another embodiment, where the where the lateral openings 800 of laterally adjacent modules 100 are generally offset from one another along the length ML of the module 100, the fluid flow between interior passageways 140 of laterally adjacent modules 100 can be directed along a length of the exterior passageway 500 between lateral openings 800.

In another embodiment, at least one of the common passageways of the individual modules 100 and the collective assembly 400 can be used to accommodate various underground facilities that may need to pass through the project site. Such underground facilities could include, without limitation, utilities, buried conduit, pipelines and any other formations as desired.

Figure 11:
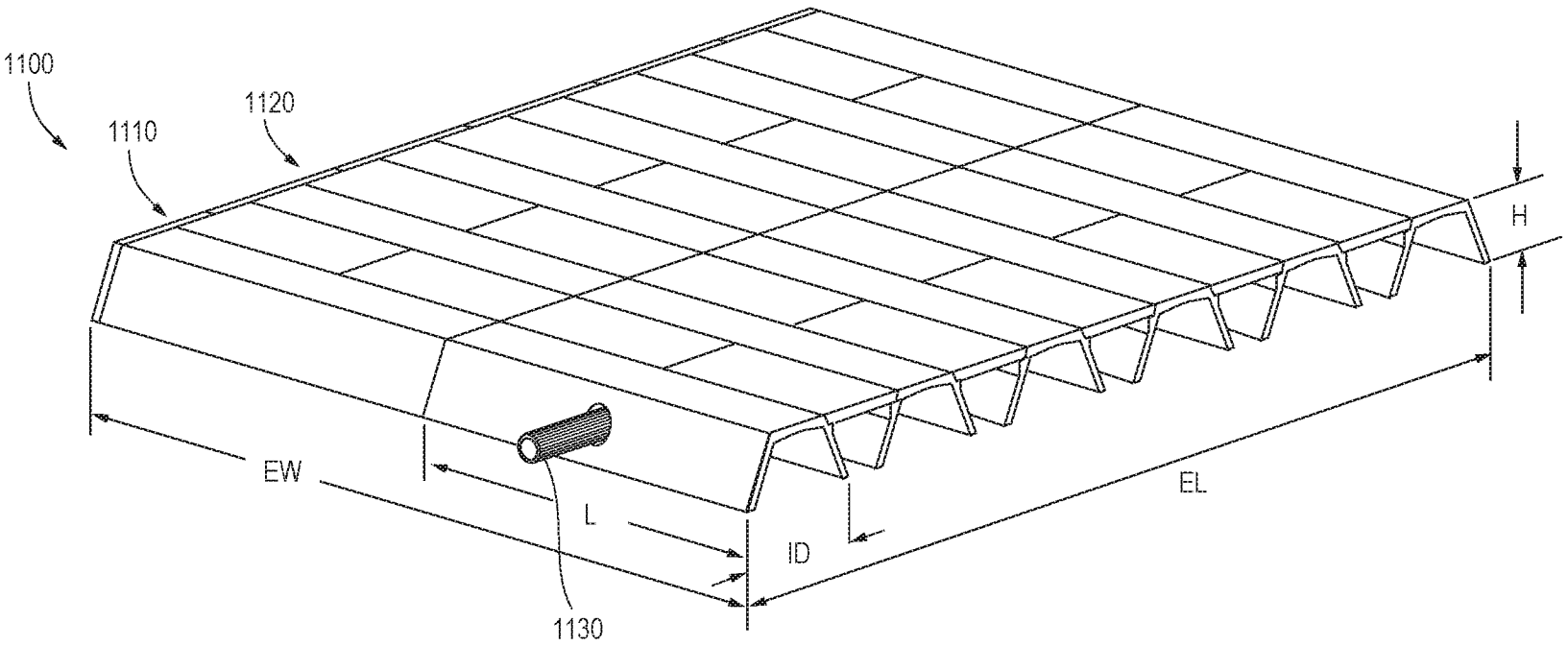
FIG. 11 is a perspective view of a fluid retention/detention assembly in accordance with one embodiment of the present invention.
Figure 12:
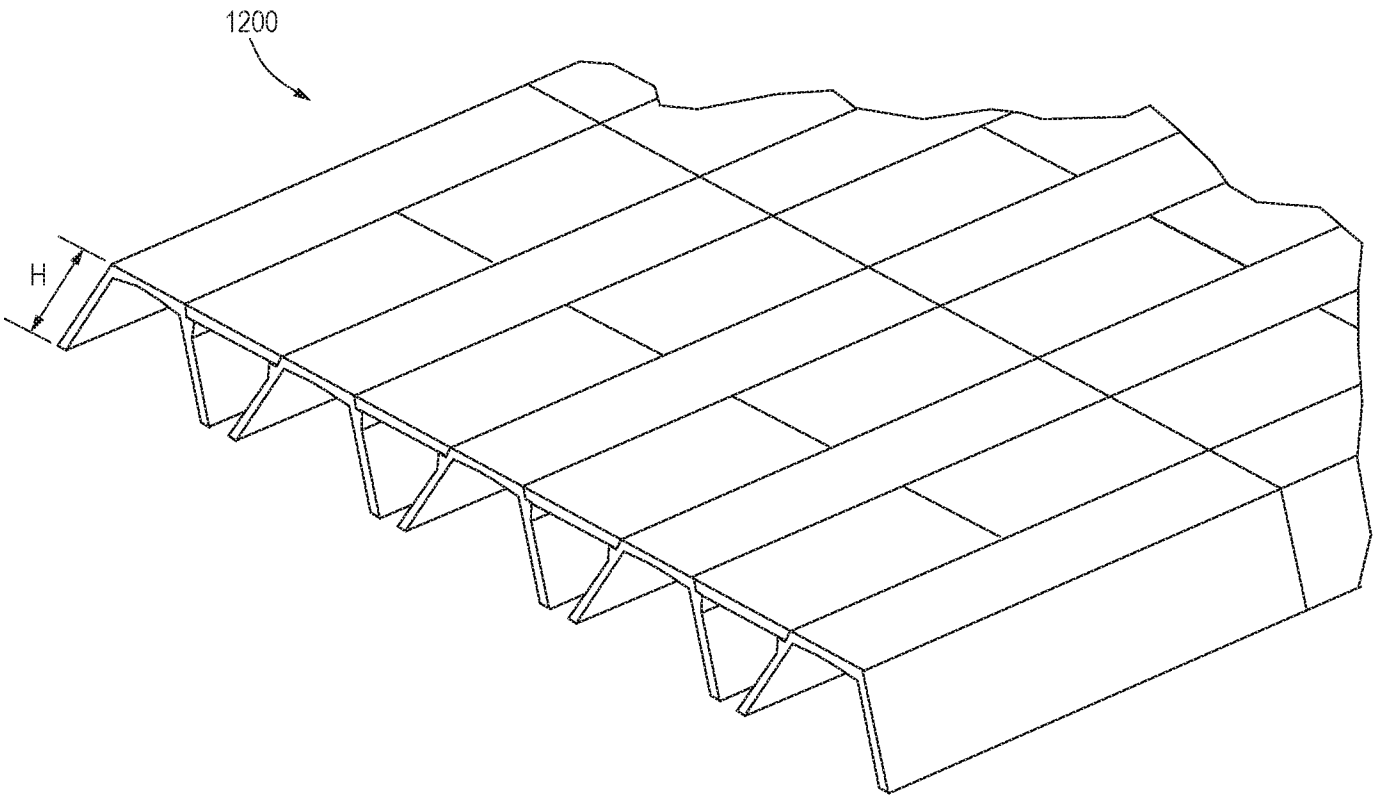
FIG. 12 is a partial perspective view of a fluid retention/detention assembly in accordance with one embodiment of the present invention.

As shown in FIG. 11, the modules 100 can, in another assembly 1100, comprise an array with modules 100 arranged side-by-side to form rows in a lateral direction and, simultaneously, end-to-end to form columns in a longitudinal direction. In one embodiment, each column can comprise a series of modules 100 arranged end-to-end, such that the longitudinal end of a first module 100 in a column is substantially flush against the longitudinal end of an adjacent second module 100 in the same column. In order to connect the modules 100 of the assembly 1100 in a longitudinal direction, the joints formed between the adjacent module 100 surfaces can be sealed with a sealant or tape, including, without limitation, bitumastic tape, wraps, filter fabric, the like, or any combination thereof.

The rows can be disposed in a lateral or transverse direction relative the longitudinal direction. For example, a series of modules 100 may be placed within an assembly 1100 in an end-to-end configuration to form a first column 1110. The first column 1110 can be generally disposed along the longitudinal direction of the assembly 1100. A second column 1120 of modules 100 may be placed adjacent to the first column 1110 to form an array of columns and rows of modules 100. Similarly, it will be understood that additional columns can be formed of modules 100 and placed adjacent to other columns comprising the assembly 1100. In one embodiment, the modules 100 can be placed in an offset or staggered orientation while also defining flow paths, such as the interior passageways 140 and the exterior passageways 500. For example, the modules 100 can be placed in an orientation similar to those orientations commonly used for laying bricks. The length or width of an assembly 1100 of modules 100 can be generally unlimited, and the modules 100 may be situated to form an assembly 1100 having an irregular or non-symmetrical shape.

As further shown in FIG. 11, in one embodiment, the assembly 1100 can comprise an influent/inlet port 1130 and/or an effluent/outlet port (not shown). The inlet port 1130 can permit fluid to enter the assembly 1100 from areas outside of the assembly 1100, such as, for example, water that is accumulating at the ground level or water from other water storage areas located either at ground level or other levels. The outlet port can be used to direct the water out of the assembly 1100 and preferably to one or more of the following offsite locations: a waterway, water treatment plants, another municipal treatment facility, or other locations that are capable of receiving water. In other embodiments, an outlet port can be located in a sidewall 110, 120 of a module 100 comprising the assembly 1100. However, it will be understood that the outlet port can be provided in other locations including, for example, the floor (not shown) the assembly 1100. A plurality of outlet ports may be placed in various locations and at various elevations in the sidewalls 110, 120 of the modules 100 comprising the assembly 1100 to release water therefrom. In one embodiment, the outlet ports of an assembly 1100 can be preferably sized generally smaller than the inlet ports 1130 of the assembly to generally restrict the flow of storm water exiting the assembly 1100. In another embodiment, water may exit the assembly 1100 through the process of infiltration or absorption through a floor of the assembly 1100 constructed of a perforate material or through other means, such as through a plurality of openings in the floor.

As shown in FIG. 11, an inlet port 1130 can be located in a sidewall 110, 120 of a module 100 comprising the assembly 1100. However, it will be understood that the inlet port 1130 can be located in the deck portions 130 of one of more modules 100 comprising the assembly 1100. Inlet ports 1130 located in a sidewall 110,120 of a module 100 can be placed in customized locations and elevations required by the preferred site requirements to receive storm water via pipes (not shown) or the like from remote locations of a site. It will be understood that multiple inlet ports 1130, or varying kinds, can be provided on an assembly 1100. For example, if a preferred location is known, the location of inlet ports 1130 may be pre-formed during the formation or manufacture of a module 100. If a preferred location is not known, the location of inlet ports 1130 may be formed during installation using appropriate tools.

FIGS. 12-15 illustrate exemplary fluid management assemblies 1200, 1300, 1400, 1500 comprised of a plurality of retention/detention modules 100 according to embodiments disclosed herein. Specifically, FIGS. 12-15 show exemplary assemblies 1200, 1300, 1400, 1500 of modules 100 having certain heights H. In one embodiment, the height H of the modules 100 can be approximately four feet. In another embodiment, the height H of the modules 100 can be approximately three feet. In yet another embodiment, the height H of the modules 100 can be approximately two feet. However, it will be understood that the H of the modules 100 of the assemblies 1200, 1300, 1400, 1500 can have any height suitable for the purposes of the present invention. It will be understood that the number or arrangement of retention/detention modules 100 in an assembly can be without limitation.

Figure 13:
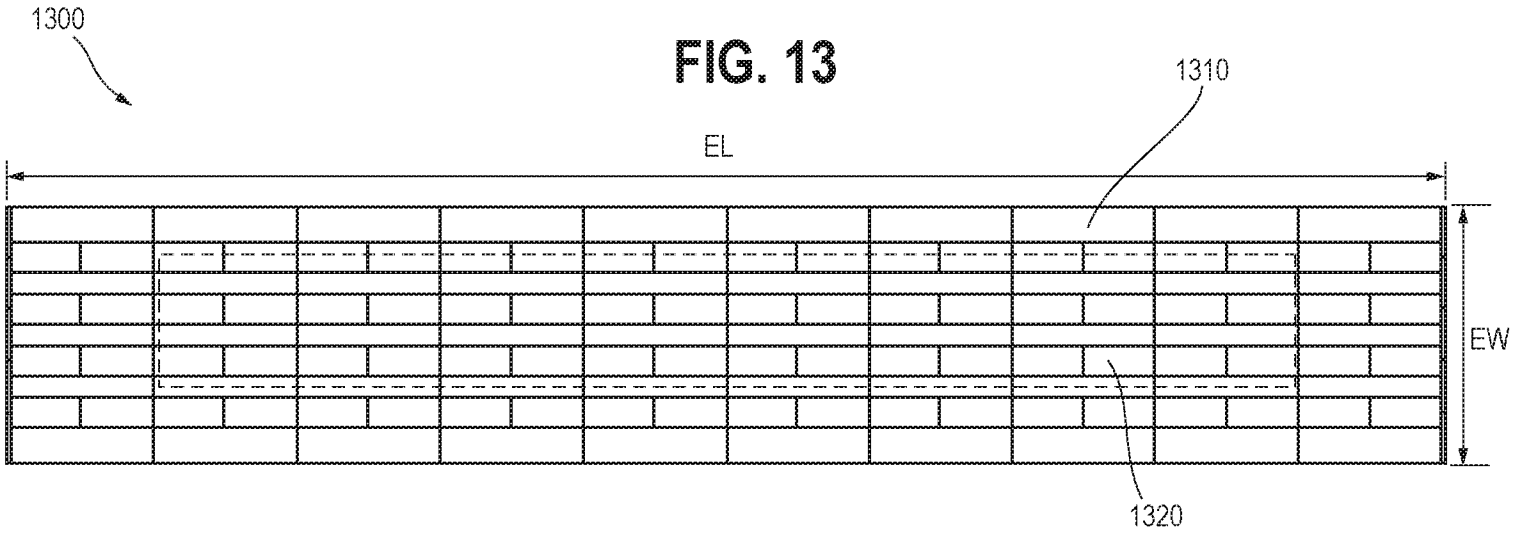
FIG. 13 is a top plan view of a fluid retention/detention assembly in accordance with one embodiment of the present invention.
Figure 14:
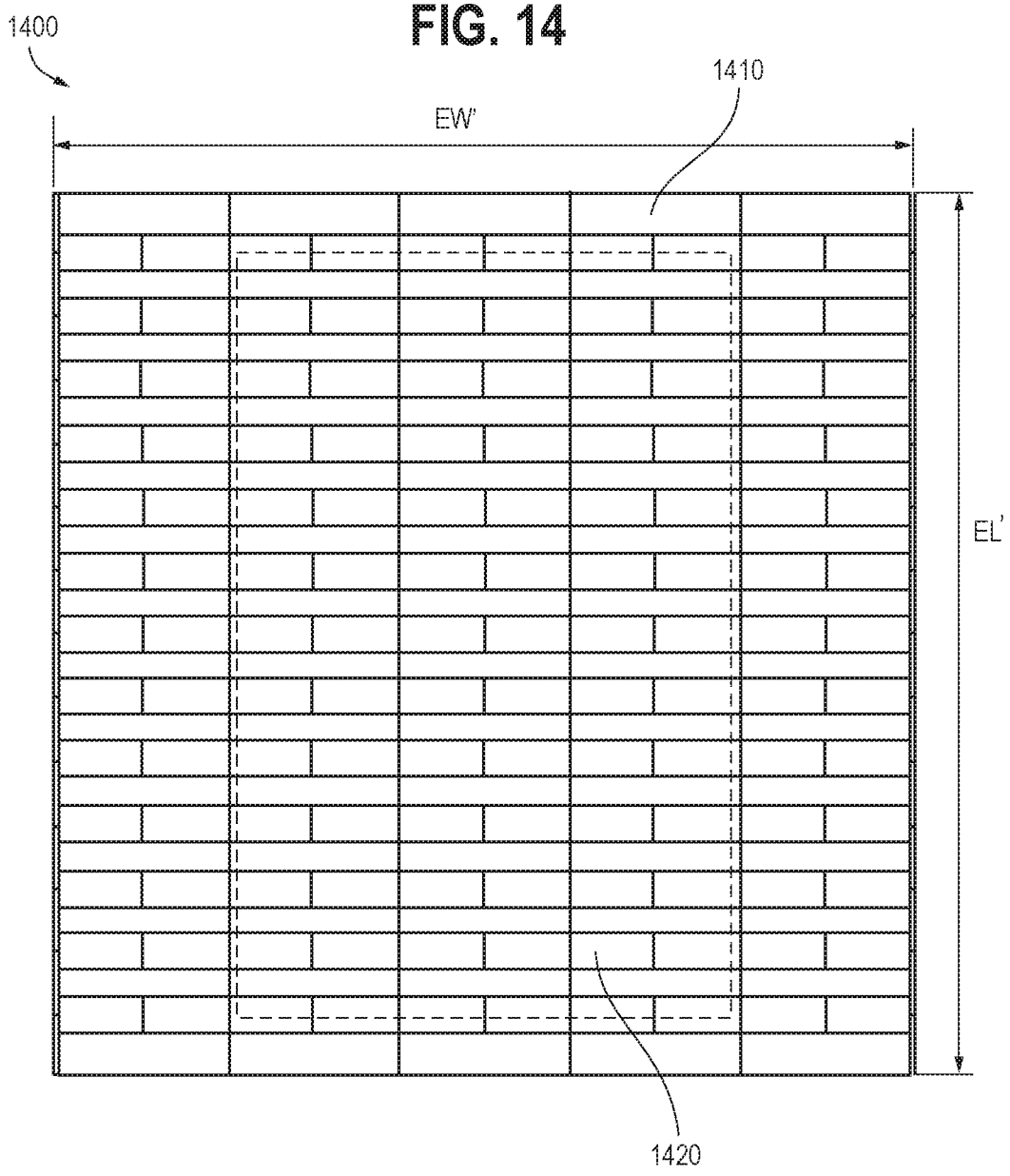
FIG. 14 is a top plan view of a fluid retention/detention assembly in accordance with one embodiment of the present invention.
Figure 15:
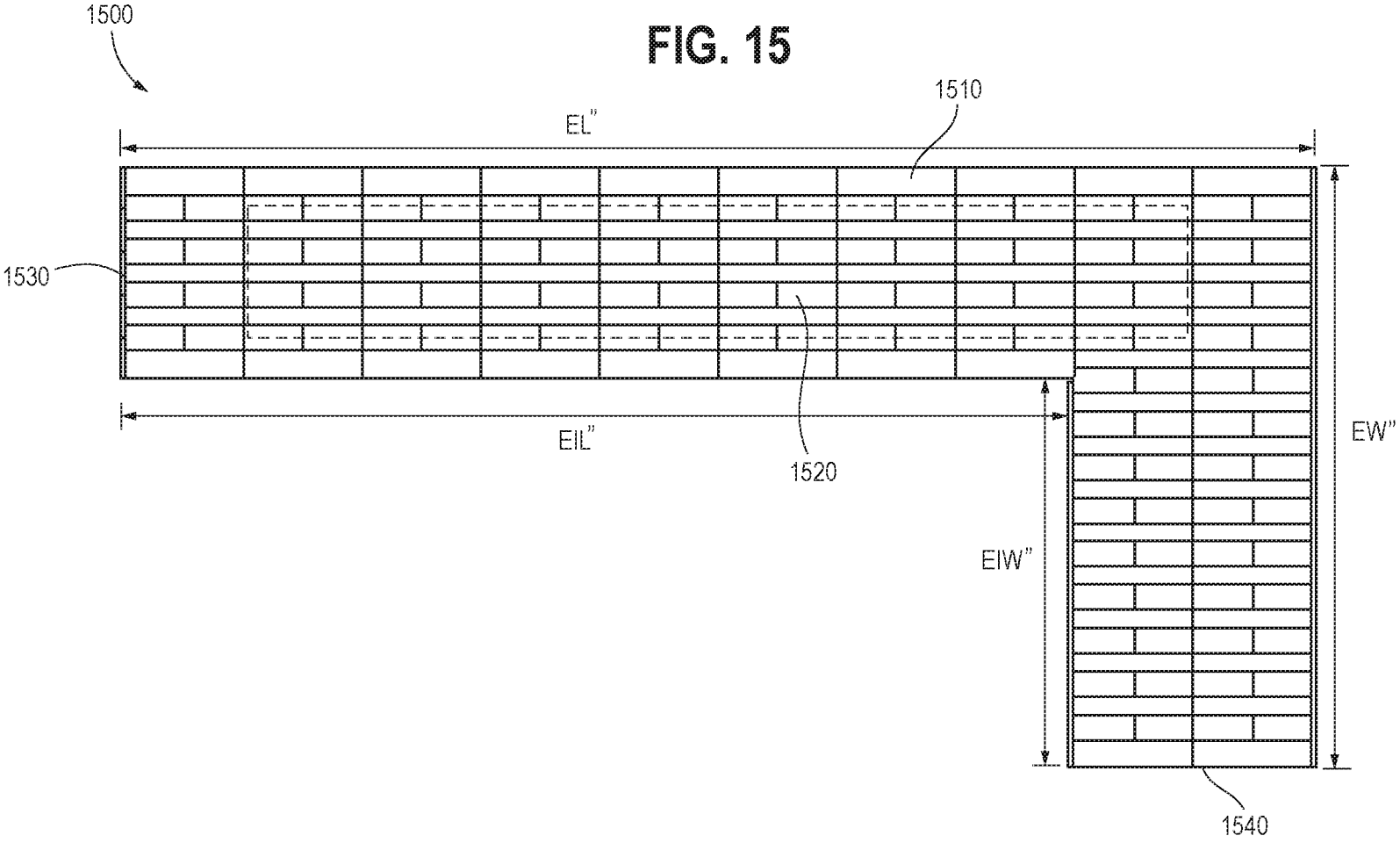
FIG. 15 is a top plan view of a fluid retention/detention assembly in accordance with one embodiment of the present invention.

As best shown in FIGS. 13-15, the assemblies 1300, 1400, 1500 can further comprise an outer perimeter 1310, 1410, 1510 of modules 100 and an inner arrangement 1320, 1420, 1520 of modules 100. The inner arrangement 1320, 1420, 1520 of modules 100 can be located within the outer perimeter 1310, 1410, 1510. In one embodiment, the outer perimeter 1310, 1410, 1510 can comprise modules 100 that can have closed longitudinal ends at each external open end (not shown) and/or solid external sidewalls (not shown) without lateral openings. In another embodiment, the longitudinal openings at each external open end of the modules 100 can be at least partially enclosed by having a separate perimeter wall (not shown) by at least partially covering the longitudinal openings along the outer periphery of the assemblies 1300, 1400, 1500. Such enclosed and impermeable arrangement of modules 100 comprising the outer perimeter 1310, 1410, 1510 can constrain fluid from exiting the assemblies 1310, 1410, 1510 through modules 100, except for fluid exiting through a provided outlet port (not shown), if provided. In another embodiment, the inner arrangement 1320, 1420, 1520 of the assemblies 1300, 1400, 1500 can be at least partially enclosed by an outer perimeter 1310, 1410, 1510. Further, the outer perimeter 1310, 1410, 1510 can comprise a partial enclosure, such that not all modules 100 of the assemblies 1300, 1400, 1500 have closed longitudinal ends at each opposing longitudinal end and/or solid external sidewalls without lateral openings.

As further shown in FIGS. 13-15, the assemblies 1300, 1400, 1500 can define effective lengths EL, EL', and EL" and effective widths EW, EW, EW". In one embodiment, as shown in FIG. 13, the effective length EL of the assembly 1300 can be on the order of between one hundred ninety feet and two hundred seventy-five feet. The effective width EW of assembly 1300 can be on the order of between thirty-five feet and fifty feet. In another embodiment, as shown in FIG. 14, the effective length EL' of the assembly 1400 can be on the order of between one hundred five feet and one hundred thirty-five feet. The effective width EW' of assembly 1400 can be on the order of between ninety-five feet and one hundred forty feet. In yet another embodiment, as shown in FIG. 15, the effective length EL" of the assembly 1500 can be on the order of between one hundred ninety feet and two hundred seventy five feet. The effective width EW' of assembly 1500 can be on the order of between one hunded feet and one hundred forty feet. Although FIGS. 13-15 illustrate exemplary assemblies according to embodiments set forth herein, it shall be understood that any configuration of modules is within the scope of the subject invention and that the overall dimensions, including the effective length and effective width, of any such assemblies can vary accordingly.

As best shown in FIG. 15, in one embodiment, the assembly 1500 can comprise a series of arrays of modules 100 that are arranged side-by-side to form rows in a lateral direction and end-to-end to form columns in a longitudinal direction. Each array of the series of arrays can comprise a varying number of rows and columns defined by the modules 100. In one embodiment, as shown in FIG. 15, the assembly 1500 generally comprises a first array 1530 of modules 100 and a second array 1540 of modules 100. The first array 1530 can comprise modules 100 arranged in nine rows and four columns. The first array 1530 of modules 100 can be arranged and coupled together in suitable manner, as disclosed herein. As shown in FIG. 15, the first array 1530 can define the effective length EL" and an effective inner length EIL". The second array 1540 can comprise modules 100 arranged in two rows and nine columns. The second array 1540 of modules 100 can be arranged and coupled together in suitable manner, as disclosed herein. The second array 1540 of modules 100 can be arranged and coupled together in suitable manner, as disclosed herein. As shown in FIG. 15, the second array 144 can define the effective width EW" and an effective inner width EIW'. In one embodiment, the effective inner length EIL" can be on the order of between one hundred twnty five feet and two hundred forty five feet. In a preferred embodiment, the effective inner length EIL" can be on the order of approximately one hundred eighty four feet. In another embodiment, the effective inner width EIW' can be on the order of between sixty feet and ninety feet. In a preferred embodiment, the effective inner width EIW' can be on the order of approximately seventy-six feet. However, it will be understood that the assemblies of the present invention can comprise any number of arrays, any arrangement of arrays, and arrays comprising any arrangement of rows and columns of modules 100, as necessary to achieve the purposes of the present invention.

Figure 16:
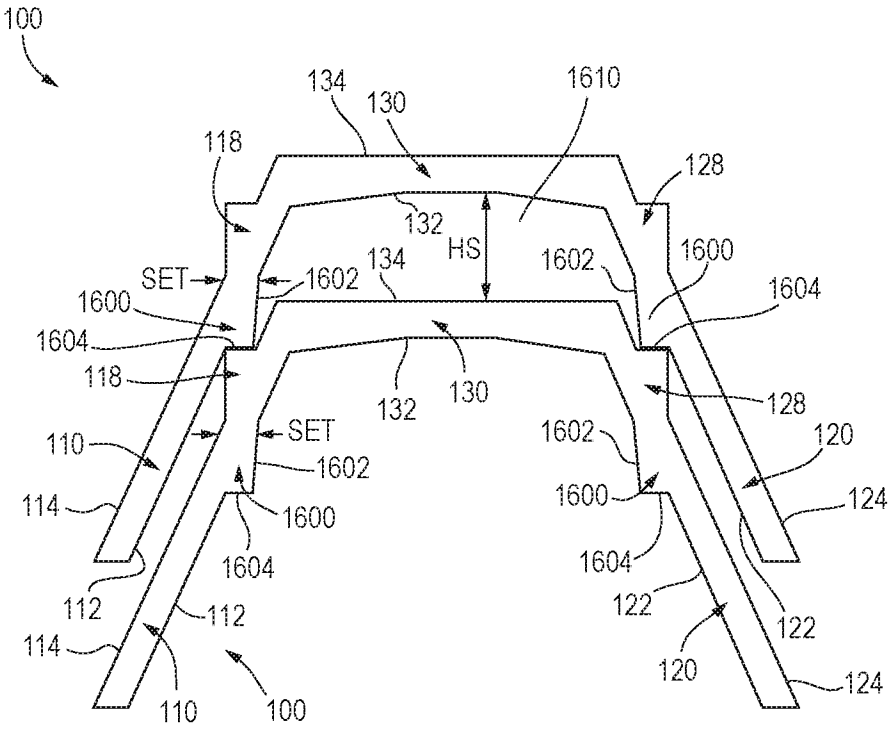
FIG. 16 is a cross-sectional front elevation view of fluid retention/detention modules in a stacked in accordance with one embodiment of the present invention.
Figure 18:
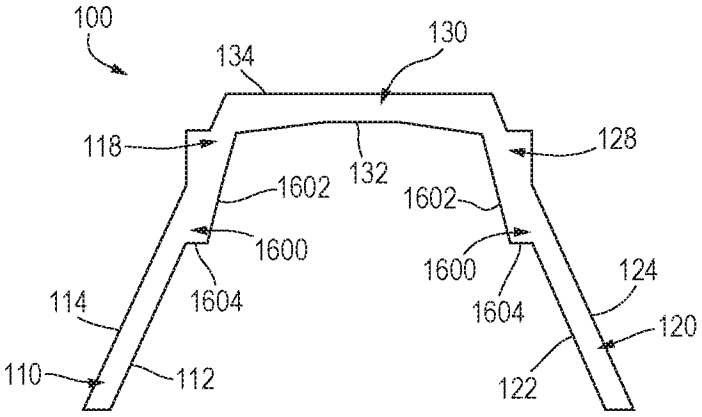
FIG. 18 is a cross-sectional front elevation view of a fluid retention/detention module in accordance with an embodiment of the present invention.
Figure 17:
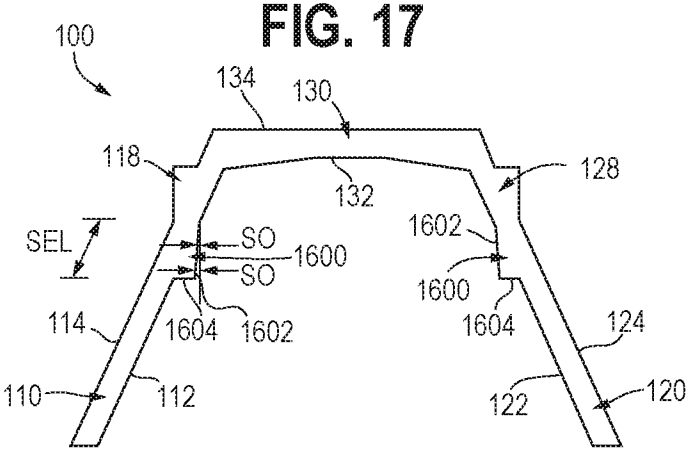
FIG. 17 is a cross-sectional front elevation view of one fluid retention/detention module of FIG. 16.

As shown in FIGS. 16-18, a module 100 can further comprise at least one seat 1600. Each seat 1600 may comprise an interior edge 1602. The seats 1600 can be coupled with the interior surfaces 112, 122 of the sidewalls 110, 120 of a module 100 and extend inward from opposing sidewalls 110, 120 and into the interior passageway 140. As shown in FIGS. 16-18, the interior edges 1602 of the seats 1600 can extend downward from a point of connection on the interior surfaces 112, 122 of the sidewalls 110, 120 and terminate at downwardly facing surfaces formed by and defined by the seats 1600. In one embodiment, the downwardly facing surfaces formed and defined by the seats 1600 can create ledges 1604. In another embodiment, the ledges 1604 of one module 100 can correspond in shape, size, and relative location with the upwardly facing surface formed on and defined by the shoulders 118, 128 of a second module 100.

As best shown in FIG. 16, the shoulders 118, 128 of a second module 100 can receive and fit together with the ledges 1604 of the first module 100 and generally support the same. In one embodiment, as shown in FIGS. 16-18, the seats 1600 can define a profile thickness SET relative to the interior surfaces 112, 122 of the sidewalls 110, 120. The profile thickness SET can enable the seats 1600 to extend downwardly away from the interior surfaces 112, 122 so that the ledges 1604 of the seats 1600 of a first module 100 can bear on the shoulders 118, 128 of another module 100. When the seats 1600 of a first module 100 can bear on the shoulders 118, 128 of another module 100, the ledges 1604 of the first module can flushly interface with the shelf created by the shoulders 118, 128. In one embodiment, the profile thickness SET of the seats 1600 relative to the interior surfaces 112, 122 of the sidewalls 110, 120 can have a taper or vary over the length of the seats 1600 as the extend downward along the interior surfaces 112, 122. In another embodiment, the profile thickness SET of the seats 1600 can be generally corresponding with the flared configuration of the exterior surfaces 114, 124 of the sidewalls 110, 120 of another module 100.

In one embodiment, when the ledges 1604 of a first module 100 are received and supported by the shoulders 118, 128 of the second module 100, a space 1610 can be provided and defined by the underside 132 of the deck portion 130 of the first module 100 and the top surface 134 of the deck portion 130 of the second module 100. In another embodiment, as shown in FIG. 16, the space 1610 can be further defined by at least a portion of the following: interior surfaces 112, 122 of the sidewalls 110, 120 of the first module 100; the seats 1600 of the first module 100; and/or the exterior surfaces 114, 124 of the sidewalls 110, 120 of the second module 100. The space 1610 can define a height HS. In one embodiment, the height HS can be on the order of between one foot and two feet. In a preferred embodiment, the height HS can be on the order of approximately one foot, six inches. In one embodiment, a distance can be defined between the interior surfaces 112, 122 of sidewalls 110, 120 of the first module 100 and the exterior surfaces 114, 124 of sidewalls 110, 120 of the second modules 100, and such distance can be on the order of between six inches and one foot, six inches.

As best shown FIG. 16, in an embodiment where the ledges 1604 of a first module 100 correspond in shape, size, and relative location with the shoulders 118, 128 of a second module 100, the two modules 100 can be stacked with the first module 100 above the second module 100. By stacking the first module 100 on top of the second module 100 to interface the seats 1600 and ledges 1604 of the first module 100 with the shoulders 118, 128 of the second module 100, this can aid in the transportation and storage of multiple modules 100 to limit transportation and storage-related damages. For example, it will be understood that the support arrangement of multiple modules 100, and spaces 1610 created thereby, can be advantageous to prevent damage to the modules 100 caused by friction and interactions between the multiple modules 100 during stacking of the same or vibration during transportation to a specific site and storage of the same. Such spaces 1610 can further prevent the modules 100 from becoming stuck or wedged together when stacked in support arrangements, which can facilitate unstacking of the modules 100. Although FIG. 16 shows two modules 100 stacked together, with one on top of the other, a person of ordinary skill in the art will understand that additional modules 100 can be stacked above the upper first module 100 and/or below the lower second module 100.

According to exemplary embodiments shown in FIGS. 16 and 17, at least one of the seats 1600 can extend downward along the interior surfaces 112, 122 of the sidewalls 110, 120 beginning at a point of connection below the point of interface or connection point between the underside 132 of the deck portion 130 and the interior surfaces 112, 122. According to an exemplary embodiment shown in FIG. 18, at least one of the seats 1600 can extend downward along the interior surfaces 112, 122 of the sidewalls 110, 120 beginning at the point of interface or connection point between the underside 132 of the deck portion 130 and the interior surfaces 112, 122. In one embodiment, the interior edges 1602 of the seats 1600 can be tapered, such that the interior edges 1602 can be set at an angle relative a vertical axis defined by the module 100. In another embodiment, the interior edges 1602 can be substantially vertical, and provided without a taper, and be parallel to a vertical axis defined by the module 100. As shown best in FIG. 16, each seat 1600 can extend downward from the point of connection on the interior surfaces 112, 122, along the interior surfaces 112, 122, for a seat length SEL in the range of six inches to eighteen inches or more, in one embodiment, and in a preferred embodiment, can be on the order of approximately ten to twelve inches.

According to embodiments presented herein, the seats 1600 can extend longitudinally continuously along all or most of the length ML of the module 100 (for example, twenty to twenty-five feet). In another embodiment, the seats 1600 can extend longitudinally intermittently along all or most of the length ML of the module 100, such that each opposing sidewall 110, 120 of a module 100 can comprise a series of sections (not shown) of the seats 1600. According to some embodiments, such series of sections of seats 1600 can have corresponding or non-corresponding locations on the opposing sidewalls 110, 120. For example, in one embodiment, the series of sections of seats 1600 can be in horizontal alignment along the interior surfaces 112, 122 of the sidewalls 110, 120 along the length ML of the module 100. In another embodiment, the series of sections of seats 1600 of one module 100 can generally correspond with the location of the shoulders 118, 128 of the same module 100. In other embodiments, the series of sections of seats 1600 of one module 100 can generally correspond with the location of corresponding shoulder 118, 128 of the sidewalls 110, 120 of another module 100. The series of sections of seats 1600 of a module 100 can define a length that can be in the range of one-foot to six-feet long, and adjacent sections of seats 1600 can be spaced apart from one another at a distance in the range of between six inches to three feet or more.

Figure 19:
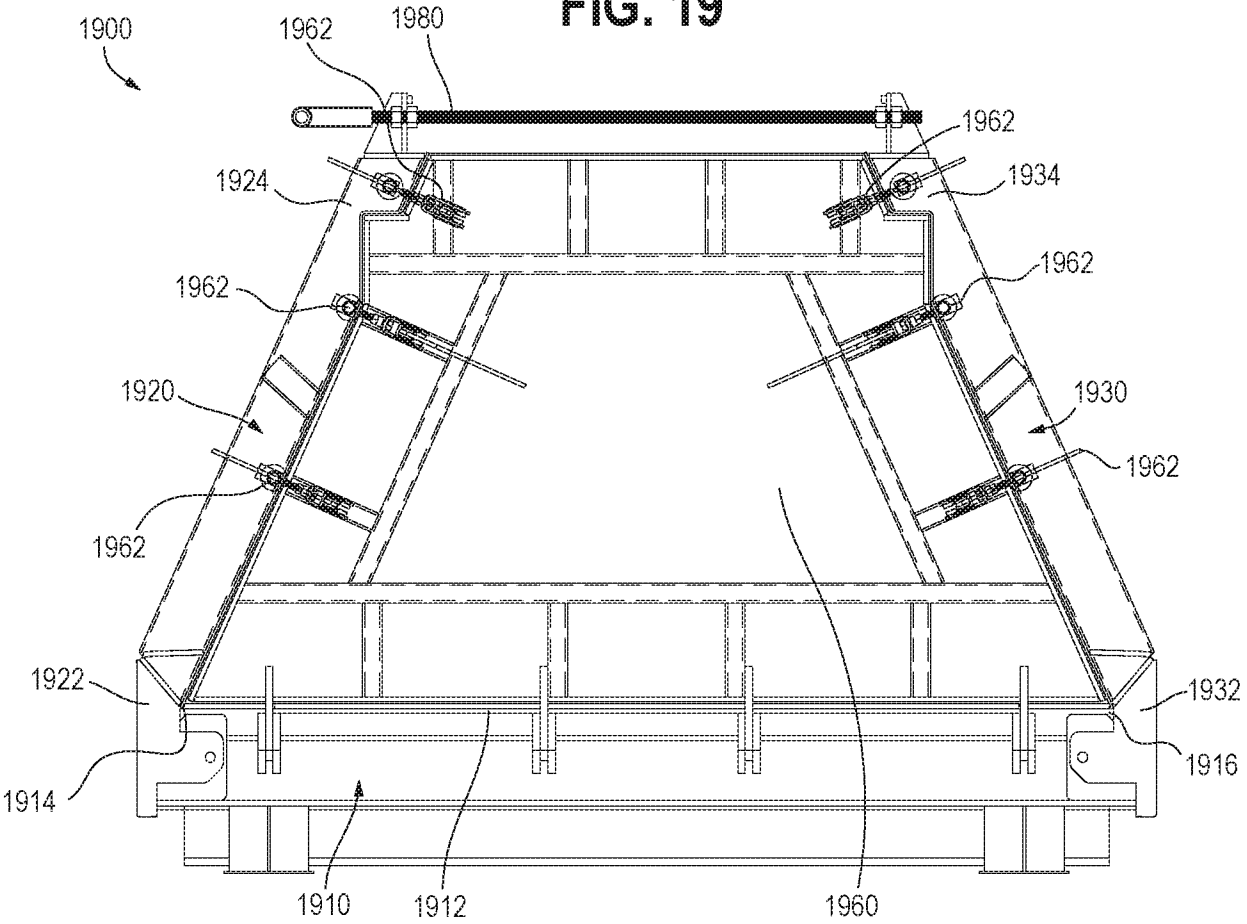
FIG. 19 is a front elevation view of an exemplary mechanical mold for the manufacture of fluid retention/detention modules in accordance with one embodiment of the present invention.
Figure 20:
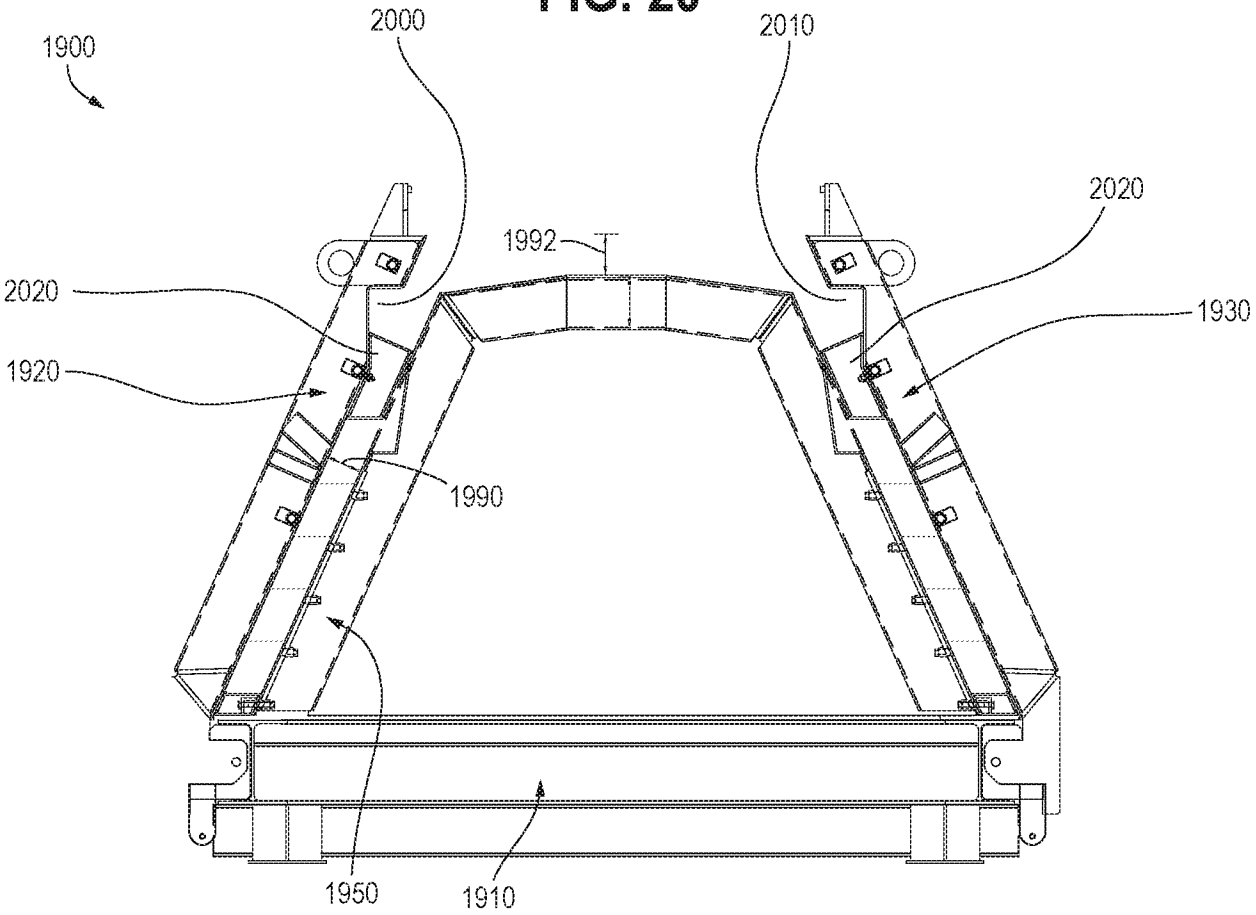
FIG. 20 is a cross-sectional front elevation view of the mechanical mold of FIG. 19 in a first position in accordance with one embodiment of the present invention.
Figure 21:
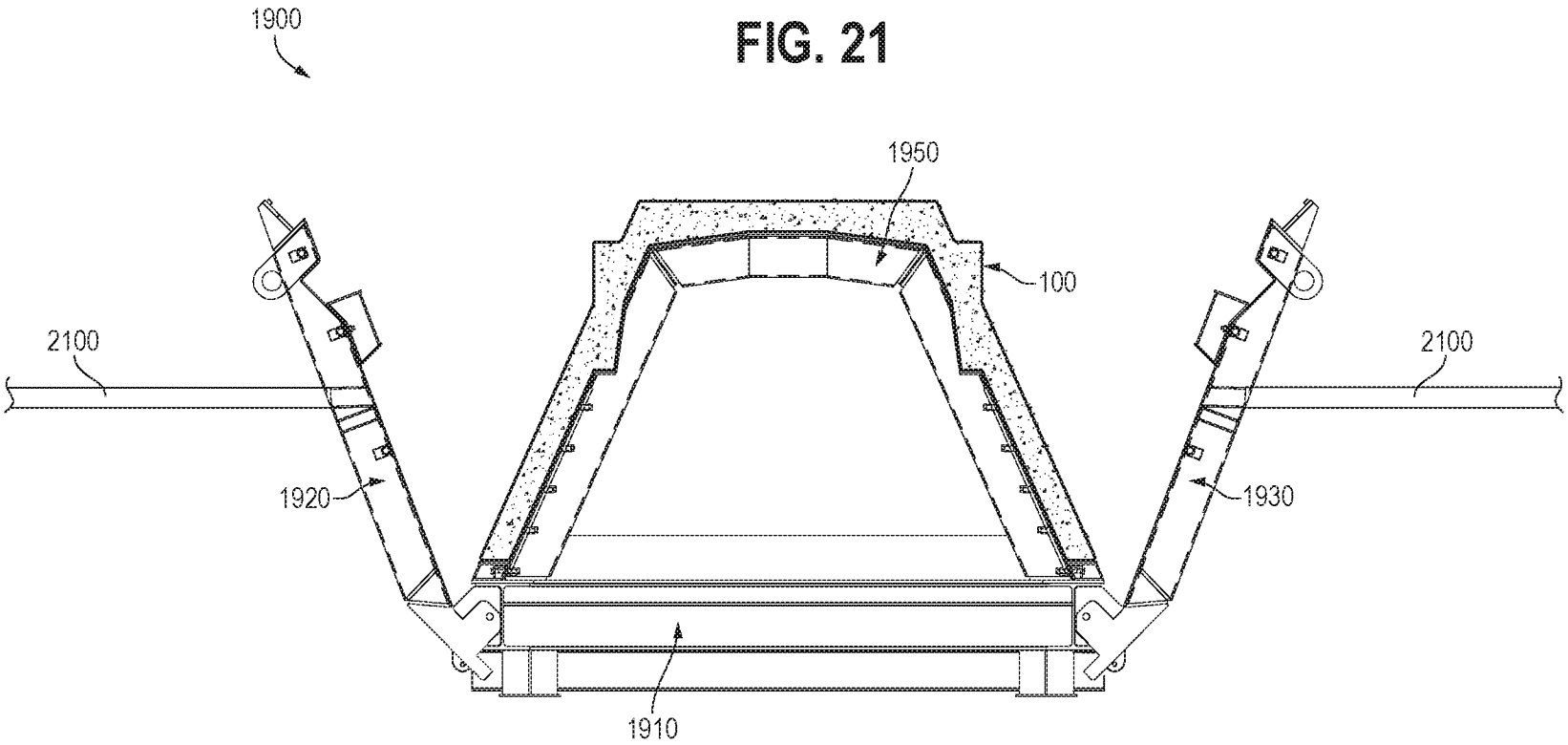
FIG. 21 is a cross-sectional front elevation view of the mechanical mold of FIGS. 19 and 20 in a second position in accordance with one embodiment of the present invention.
Figure 22:
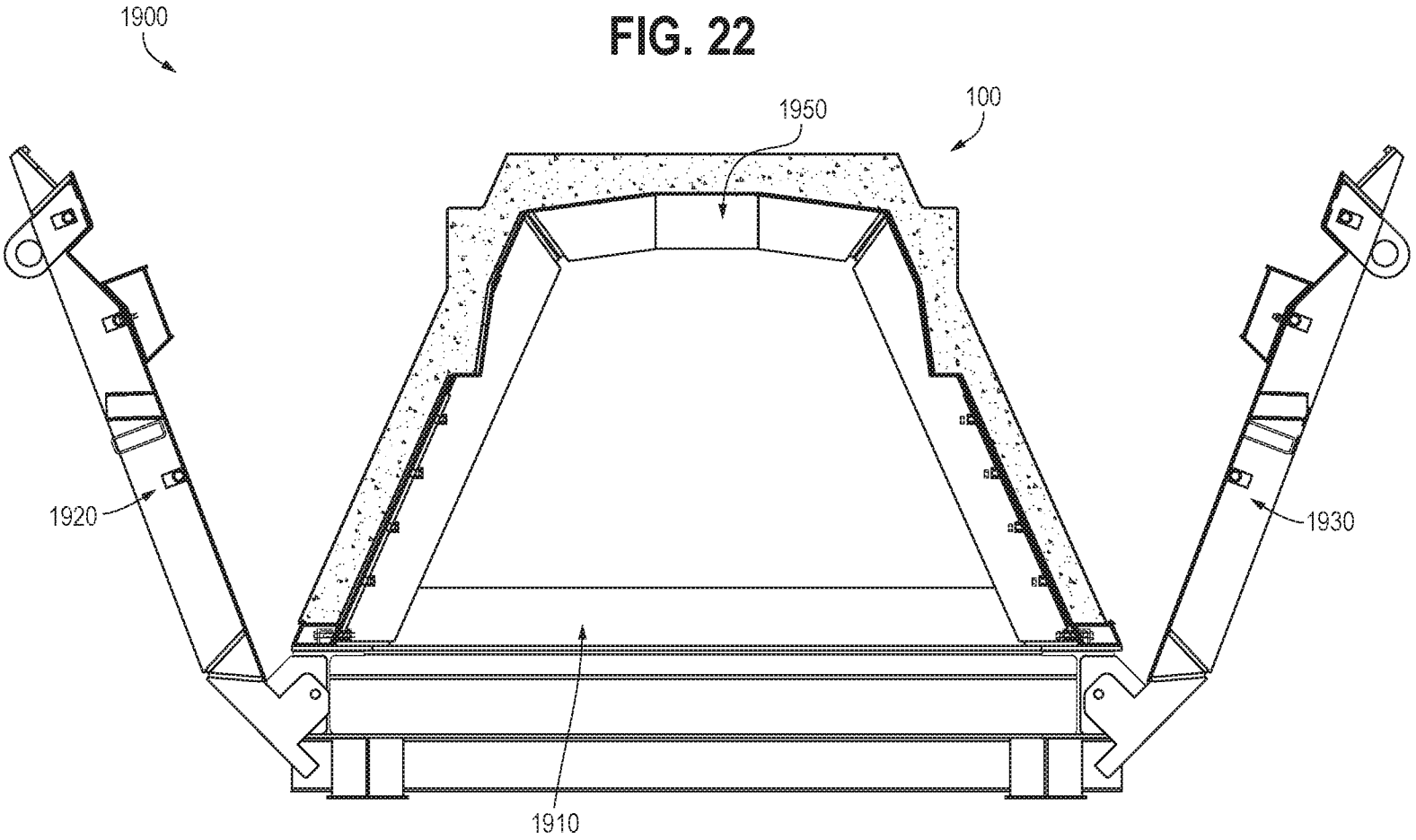
FIG. 22 is a cross-sectional front elevation view of the mechanical mold of FIGS. 19-21 in a second position in accordance with one embodiment of the present invention.

FIGS. 19-30 illustrate a mechanical mold or jacket 1900 for the manufacture of fluid retention/detention modules 100 according to one embodiment of the present invention. According to exemplary embodiments shown schematically in FIGS. 19-30, the mold 1900 can be purposed for reuse for the recurring manufacture of pluralities of modules. In one embodiment, the mold 1900 can comprise a lower portion 1910, a first opposing arm 1920, a second opposing arm 1930, a lid 1940, and a bulkhead 1950. The lower portion 1910 may further comprise a substantially horizontal base platform 1912 defined by a first longitudinal side 1914 and a second longitudinal side 1916. In one embodiment, the first opposing arm 1920 may further comprise a proximal end 1922 and a distal end 1924. In another embodiment, the second opposing arm 1930 may further comprise a proximal end 1932 and a distal end 1934. The opposing arms 1920, 1930 may be hingedly secured to connection points along the longitudinal sides 1914, 1916. In one embodiment, the proximal ends 1922, 1932 of the opposing arms 1920, 1930 may be hingedly secured to connection points along the longitudinal sides 1914, 1916, and the distal ends 1924, 1934 may define a free end of the opposing arms 1920, 1930. The arms 1920, 1930 can be configured to rotate or pivot, relative to the base platform 1912, between a first or closed position, as best shown in FIGS. 19 and 20, and a second or open position, as best shown in FIGS. 21 and 22. In the first position, the arms 1920, 1930 extend over and define a void or space 1990 with the bulkhead 1950, as best shown in FIG. 20. Similarly, when the arms 1920, 1930 are in the first position and the lid 1940 is operably coupled thereto, the lid 1940 can span a space or distance defined by the distal ends 1924, 1934 of the arms 1920, 1930 and extend over and define a void or space 1992 with the bulkhead 1950, as indicated in FIG. 20.

In another embodiment, the mold 1900 may further comprise a first end plate 1960, a second end plate 1970, and a fastening device 1980. As best shown in FIG. 19, the end plates 1960, 1970 can comprise a plurality of latches 1962, 1972. The plurality of latches 1962, 1972 can be provided to operably couple the end plates 1960, 1970 to the mold 1900. In one embodiment, the plurality of latches 1962, 1972 can engage with the arms 1920, 1930 of the mold 1900 to the secure the same in the first position. In one embodiment, the plurality of latches 1962, 1972 can be used in conjunction with the fastening device 1980 to secure the arms 1920, 1930 in the first position.

The fastening device 1980 can be provided and used to engaged the opposing arms 1920, 1930 against the exterior edges of the lid 1940 to secure the opposing arms 1920, 1930 in the first position. The fastening device 1980 can be a turnbuckle or similar fastening means suitable for the purposes of the present invention, whether presently known of later developed. As shown in FIG. 21, in one embodiment, the arms 1920, 1930 can be rotated or pivoted to the second position through the use of at least one pry bar 2100.

As best shown in FIG. 20, the bulkhead 1950 can be positioned or located along a central axis defined by the lower portion 1910 of the mold 1900. As further shown in FIG. 20, the opposing arms 1920, 1930 can define notched sections 2000, 2010. The notched sections 2000, 2010 can define a void of a size and shape corresponding to the desired profile size and shape of the shoulders (not shown) of a module (not shown), according to embodiment presented herein, being fabricated. Therefore, the notched sections 2000, 2010 can be provided and configured to form the shoulders of the module. In another embodiment, the arms 1920, 1930 may further comprise windows 2020 along their lengths for accommodating knockouts during fabrication of modules.

Figure 23:
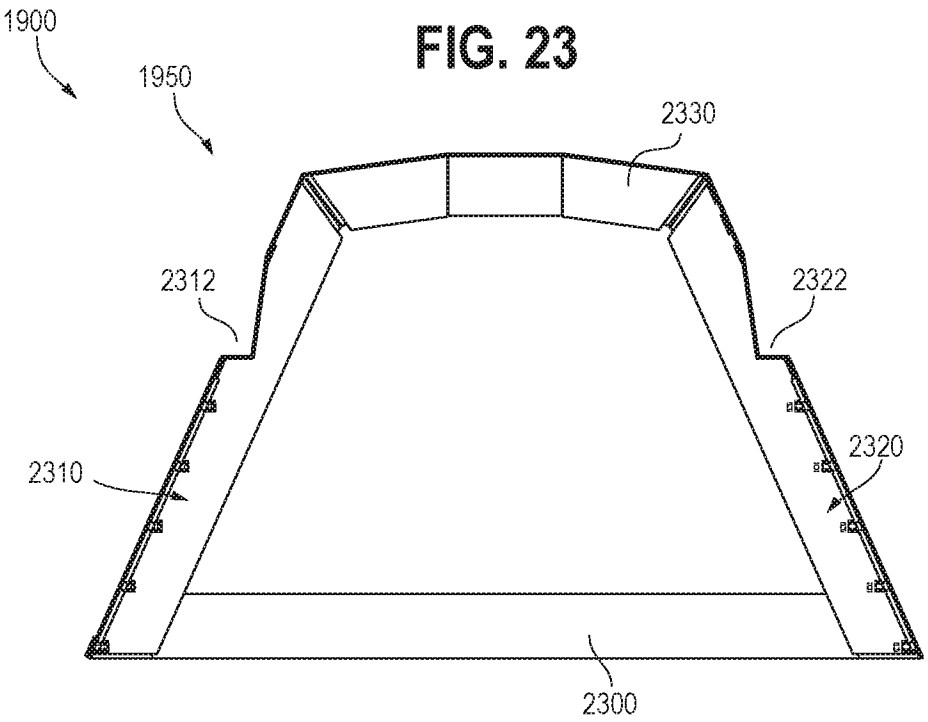
FIG. 23 is a front elevation view of a bulkhead of the mechanical mold of FIGS. 19-22.

As best shown in FIG. 23, the bulkhead 1950 may comprise a bottom portion 2300, a first opposing side portion 2310, a second opposing side portion 2320, and a roof portion 2330. In one embodiment, the outer surfaces of the side portions 2310, 2320 can define notched sections 2312, 2322. The notched sections 2312, 2322 can define a void of a size and shape corresponding to the desired profile size and shape of the seats (not shown) and ledges (not shown) of a module (not shown), according to embodiment presented herein, being fabricated. Therefore, the notched sections 2312, 2322 can be provided and configured to form the seats and ledges of the module. In another embodiment, the opposing side portions 2310, 2320 can be operably coupled with the roof portion 2330 and extend downward and outward therefrom, which can define a general flare configuration for the bulkhead 1950. The opposing side portions 2310, 2320 can also be operably coupled with bottom portion 2300. In one embodiment, the bulkhead 1950 can be operably coupled with the mold 1900 and positioned along a central longitudinal axis defined by the lower portion (not shown) of the mold 1900.

Figure 24:
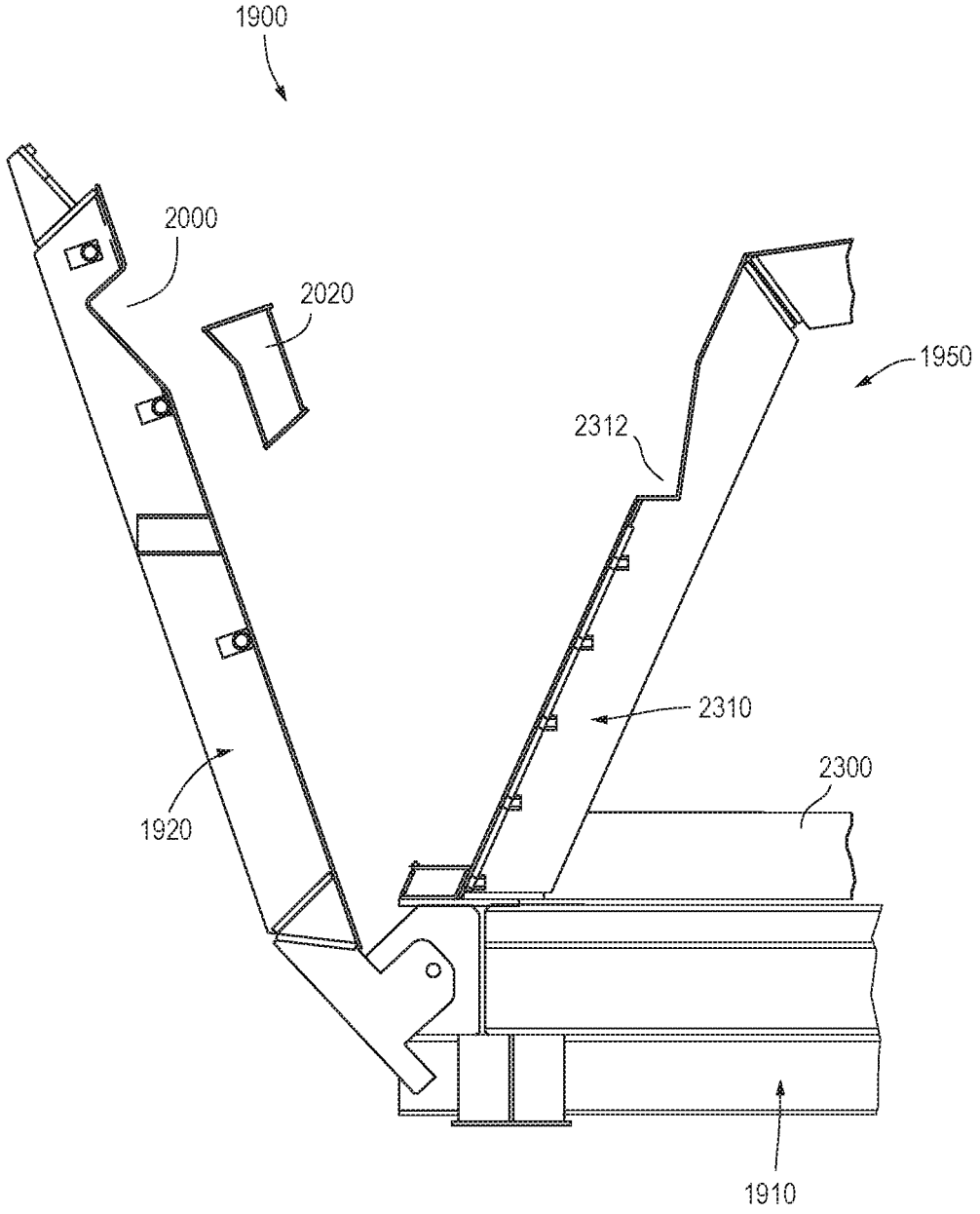
FIG. 24 is a cross-sectional partial front elevation detail view of the mechanical mold of FIGS. 19-23.

As shown in FIGS. 19-24, the mold 1900, and its components, can be configured to define a void of a size and shape corresponding to the desired profile size and shape of the module being fabricated. In one embodiment, the bulkhead 1950, and its components, can have a size and shape corresponding to lower portion 1910, opposing arms 1920, 1930, and lid 1940 of the mold 1900. In another embodiment, as best shown in FIG. 24, the notched sections 2000, 2010 of the opposing arms 1920, 1930 can align with the notched sections 2312, 2322 of the opposing portions 2312, 2322 of the bulkhead 1950.

Figure 25:
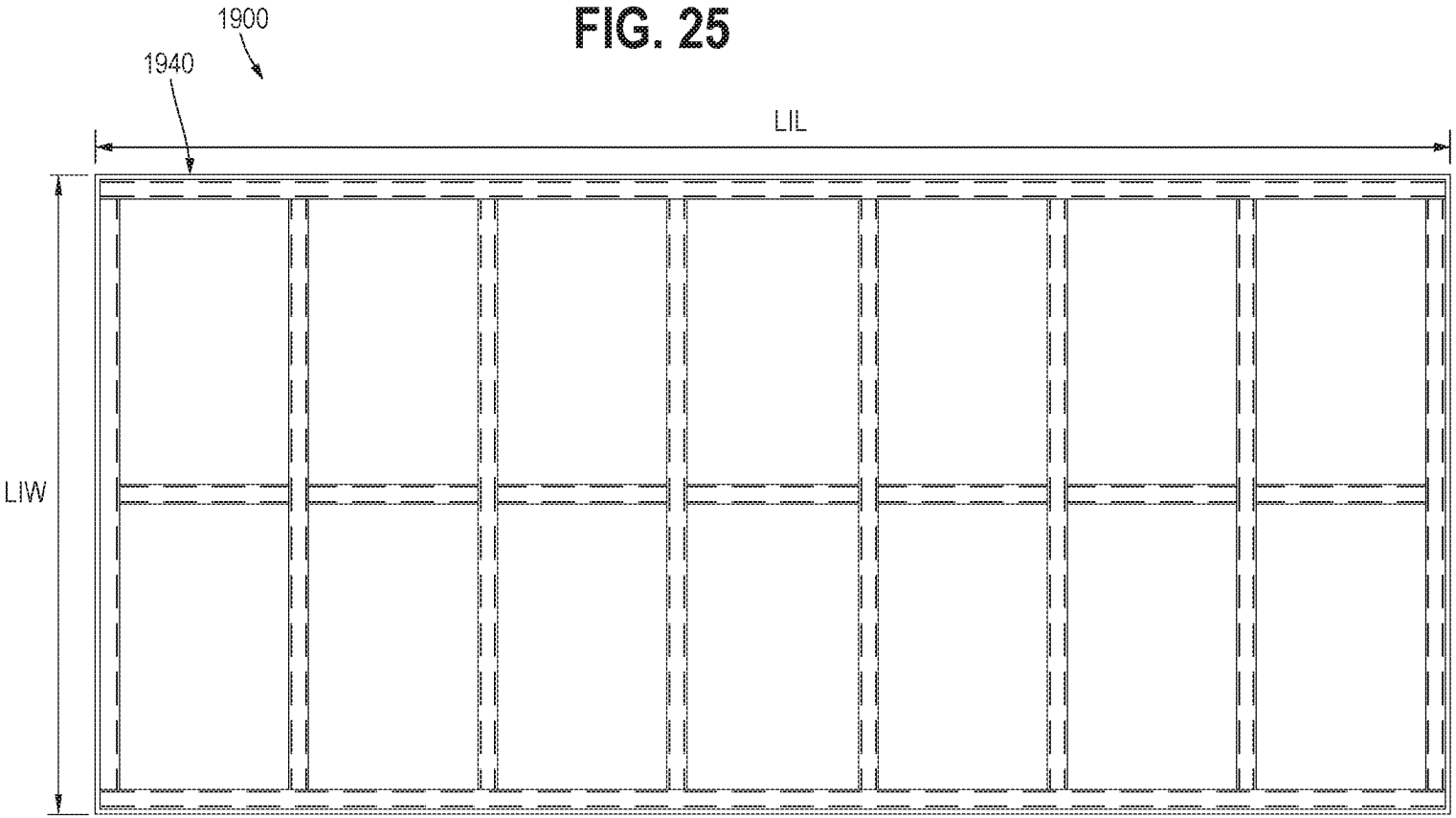
FIG. 25 is a top plan view of a lid of the mechanical mold of FIGS. 19-24.
Figure 26:
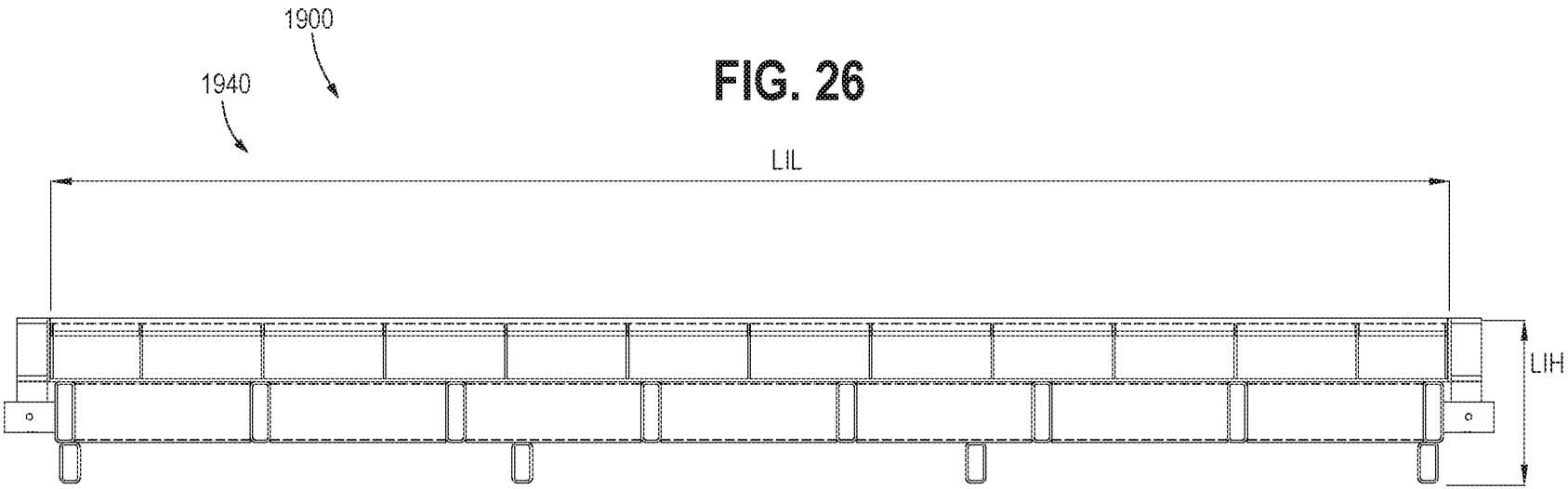
FIG. 26 is a side elevation view of the lid of the mechanical mold of FIGS. 19-25.
Figure 27:
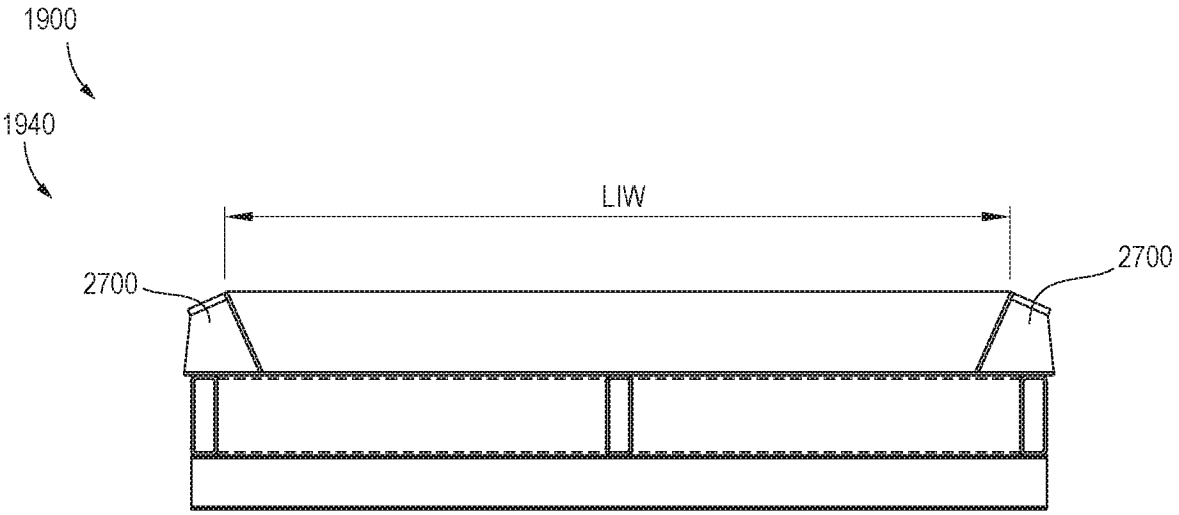
FIG. 27 is a cross-sectional front elevation view of the lid of the mechanical mold of FIGS. 19-26.

As shown in FIGS. 25-27, the lid 1940 can be configured to correspond with the desired size and shape of the deck portion (not shown) of the module (not shown) being fabricated. As best shown in FIG. 25, the lid 1940 can define a lid length LIL and a lid width LIW. In one embodiment, the lid length LIL can be on the order of between ten feet and twenty-five feet. In a preferred embodiment, the lid length LIL can be on the order of approximately 20 feet. In another embodiment, the lid width LIW can be on the order of between fifty inches and eighty inches. In a preferred embodiment, the lid width LIW can be on the order of approximately sixty-five inches. As best shown in FIG. 26, the lid 1940 can further define a lid height LIH. In one embodiment, the lid height LIH can be on the order of between ten inches and twenty-two inches. In a preferred embodiment, the lid height LIH can be on the order of approximately 16.25 inches. As best shown in FIG. 27, the lid 1940 may further comprise at least one gusset 2700. In one embodiment, each gusset 2700 may be coupled to the lid 1940. In another embodiment, the gusset 2700 may be a 0.25-inch gusset that is on the order of six inches tall.

Figure 28:
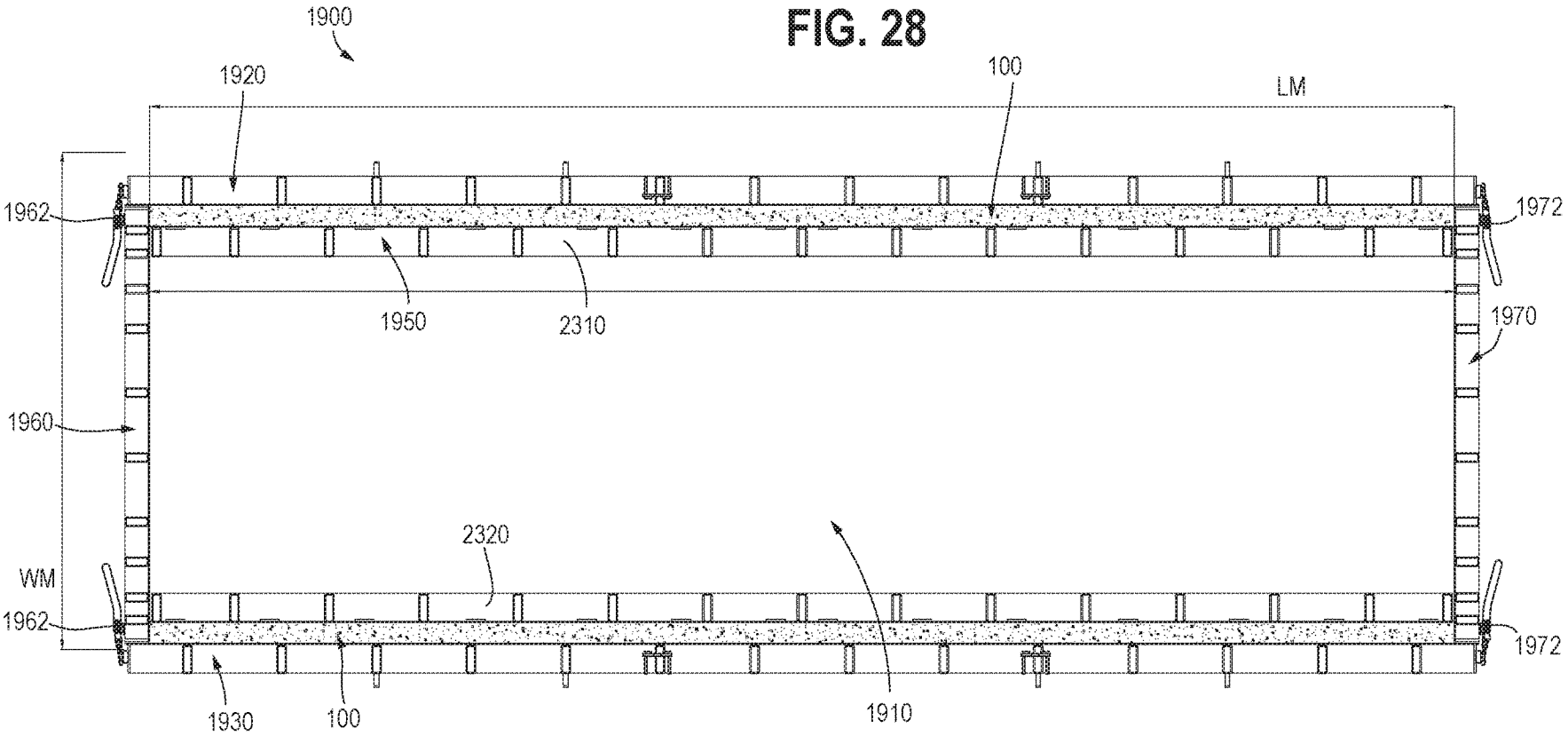
FIG. 28 is a cross-sectional top plan view of the mechanical mold of FIG. 28 in a first position with a module.
Figure 29:
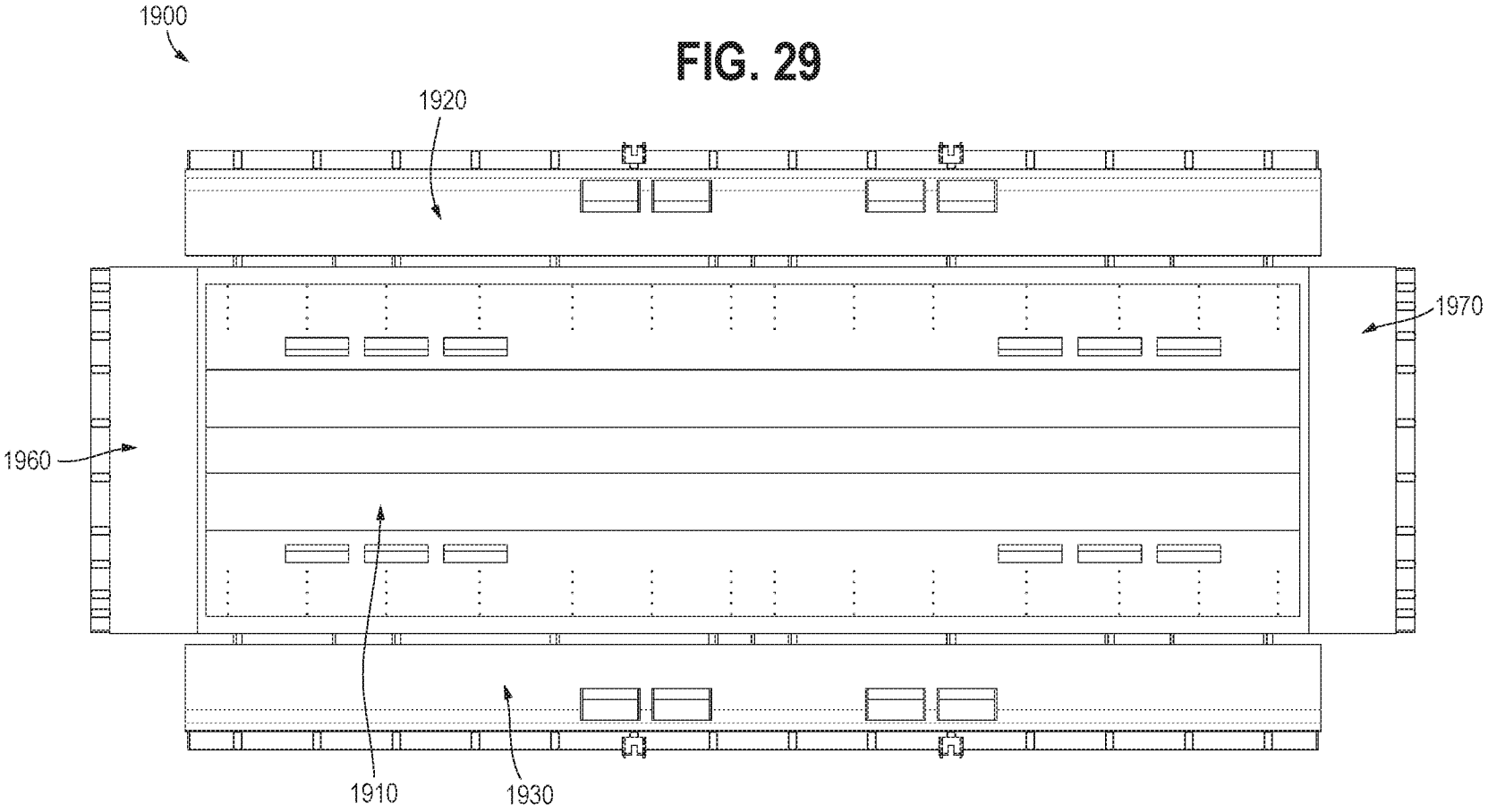
FIG. 29 is a top plan view of the mechanical mold of FIG. 29 in a second position without a module.

As shown in FIGS. 28 and 29, the arms 1920, 1930 can be configured to extend along the entire length LM of the mold 1900, such that the arms 1920, 1930 can have lengths that correspond with the length of the lower portion 1910. As shown in FIG. 29, the first end plate 1960 and the second end plate 1970 of the mold 1900 can be configured to extend along the width WM of the mold 1900, such that the end plates 1960, 1970 can have widths that correspond with the width of the lower portion 1910.

Figure 30:
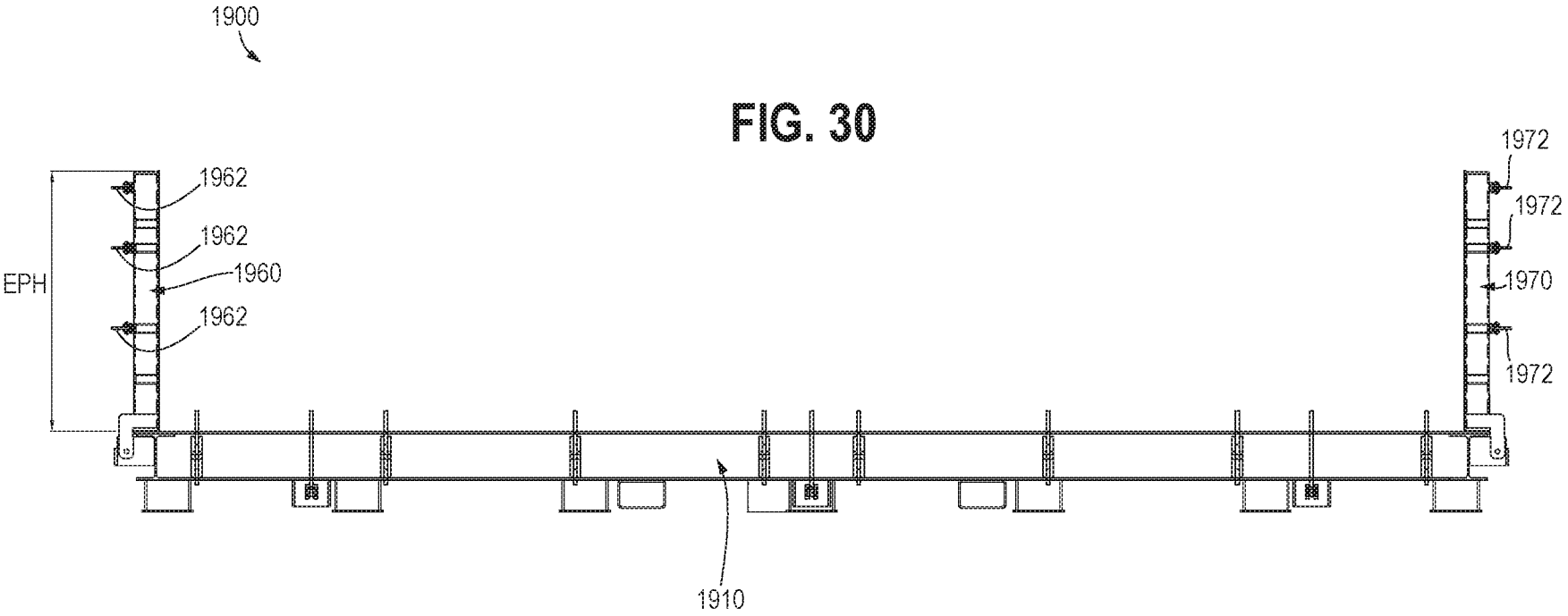
FIG. 30 is a side elevation view of the mechanical mold of FIGS. 28 and 29 in a second position without a module.

As shown in FIG. 30, the end plates 1960, 1970 can be secured to connection points along the lateral sides of the lower portion 1910 of the mold 1900. Each end plate 1960, 1970 can define a height EPH. In one embodiment, the end plate height EPH can be on the order of between ten inches and seventy inches. In a preferred embodiment, the end plate height EPH can be on the order of approximately fifty-five inches.

Figure 31:
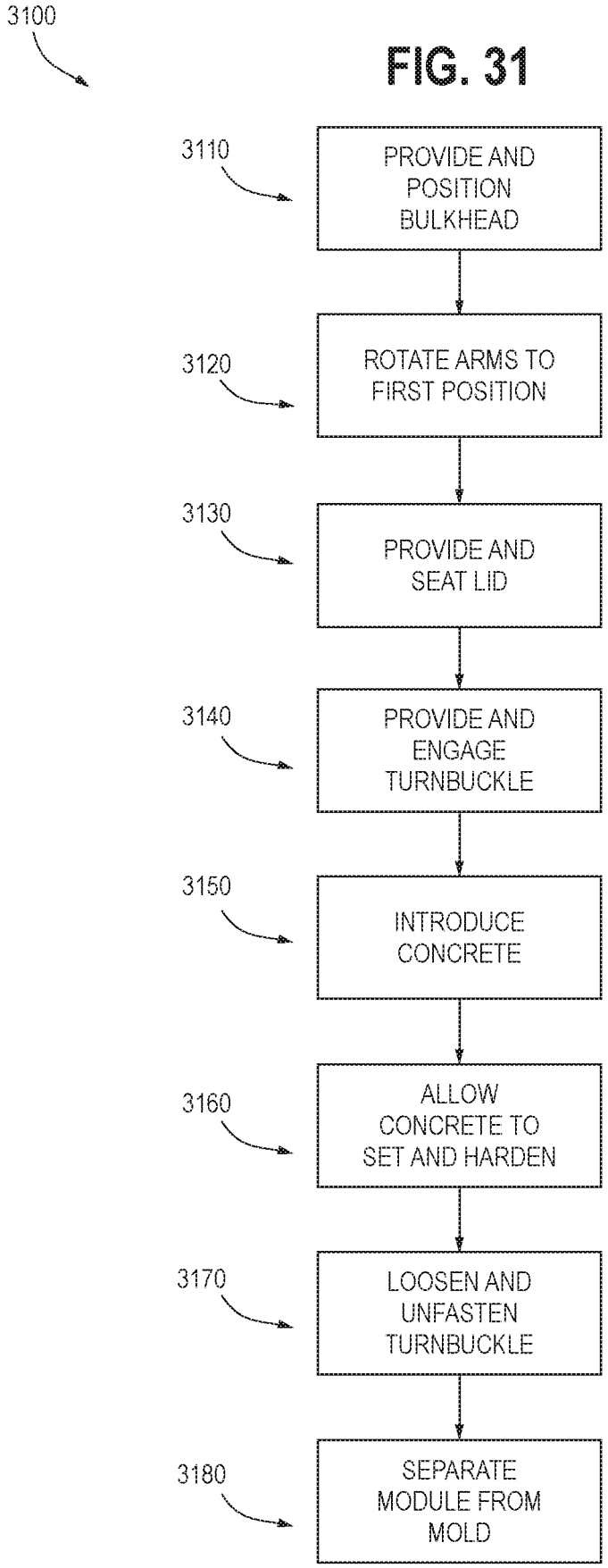
FIG. 31 is a schematic diagram of a method for the manufacture of fluid retention/detention modules in accordance with exemplary embodiments disclosed herein.

According to exemplary embodiments, a method or process of manufacturing modules 100 using a mold 1900, of the type presented herein, can also be provided with the present invention. FIG. 31 is a diagram depicting an example method 3100 for manufacturing modules 100 using the mold 1900. As indicated by block 3110, a bulkhead 1950 can be provided and positioned along a central longitudinal axis defined by a lower portion 1910 of a mold 1900. Block 3120 illustrates how, after placement of the bulkhead 1950 in the mold 1900, the opposing arms 1920, 1930 of the mold 1900 can be rotated or pivoted to the first position. Such rotation of the opposing arms 1920, 1930 can be achieved by rotating the distal ends 1924, 1934 of the respective arms 1920, 1930 toward each other until the arms 1920, 1930 extend over and define a void or space 1990 with the opposing portions 2310, 2320 of the bulkhead 1950. In one embodiment, when the arms 1920, 1930 are in the first position, the arms 1920, 1930 may be substantially parallel to the opposing portions 2310, 2320. As indicated by block 3130, upon rotating the arms 1920, 1930 to the first position, a lid 1940 can be provided and seated or placed across the top of the mold 1900, such that it is contacted and supported by the distal ends 1924, 1934 of the arms 1920, 1930. In such placement, the lid 1940 can span a space or distance defined by the distal ends 1924, 1934 of the arms 1920, 1930 when the arms 1920, 1930 are in the first position. The lid 1940 can extend over and define a void or space 1992 with the roof portion 2330 of the bulkhead 1950. Block 3140 illustrates how a fastening device 1980 can be provided and used to engaged the opposing arms 1920, 1930 against the exterior edges of the lid 1940 to secure the opposing arms 1920, 1930 in the first position during use of the mold 1900 to manufacture modules 100. In one embodiment, a plurality of latches 1962, 1972 can be provided and used in conjunction with the fastening device 1980 to secure the arms 1920, 1930 in the first position. Block 3150 illustrates how concrete can be introduced into the void or space defined by the mold 1900 and the bulkhead 1950. As illustrated by block 3160, the concrete can then be allowed to set and harden. Block 3170 illustrates how after the concrete has hardened, the fastening device 1980 can be loosened and unfastened. By loosening and unfastening the fastening device 1980, the lid 1940 can be removed and the opposing arms 1920, 1930 can be rotated or pivoted down from the first position to the second position. In one embodiment, the plurality of latches 1962, 1972 can be released from the arms 1920, 1930 so that they can be rotated or pivoted to the second position. Block 3180 illustrates how the formed module 100 can be lifted or separated from the mold 1900 and the bulkhead 1950.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

Further, logic flows depicted in the figures do not require the particular order shown, or sequential order, to achieve desirable results. Other steps may be provided, or steps may be eliminated, from the described flows, and other components may be add to, or removed from the described embodiments.

What is claimed is:

1. A modular assembly for managing the flow of fluid beneath a ground surface, the assembly comprising:

a first precast concrete module comprising a first deck portion having a first top deck surface, opposing spaced-apart sidewalls integrally formed with and extending downward from opposing longitudinal sides of the first deck portion to respective bottom edges, and at least one open end, the opposing spaced-apart sidewalls sloping outward and away from one another as they extend downward from the first deck portion to the respective bottom edges;

at least one shoulder extending outward from at least one of the opposing spaced-apart first sidewalls; and a link slab supported by the at least one shoulder and comprising a top slab surface being flush with the first top deck surface;

wherein:

the first deck portion and the opposing spaced-apart sidewalls define an interior fluid passageway with respect to the first module, the interior fluid passageway having a top portion adjacent an underside of the first deck portion and a bottom portion adjacent the respective bottom edges of the opposing sidewalls, the interior fluid passageway having a flared configuration which widens as it extends from the top portion to the bottom portion; and the interior fluid passageway defines a longitudinal flow path.

2. The assembly of claim 1 further comprising at least one seat extending inward from the opposing spaced-apart sidewalls.

3. The assembly of claim 1, wherein the opposing spaced-apart sidewalls each comprise at least one lateral opening therethrough, the at least one lateral opening defining a lateral fluid channel that is in fluid communication with the interior fluid passageway, the lateral fluid channel defining a lateral flow path through the assembly.

4. The assembly of claim 3, wherein the at least one lateral opening is located adjacent the respective bottom edges of the opposing sidewalls.

5. The assembly of claim 3, wherein the at least one lateral opening is elevated from the respective bottom edges of the opposing sidewalls.

6. The assembly of claim 1 further comprising:

a second precast concrete module comprising a second deck portion having a second top deck surface and a first sidewall integrally formed with and extending downward from a first longitudinal side of the second deck portion to a bottom edge;

at least one shoulder extending outward from the first sidewall of the second module;

wherein:

the first sidewall of the second precast concrete module is laterally adjacent to a first sidewall of the opposing spaced-apart sidewalls of the first precast concrete module;

the link slab and the first sidewalls of the first and second modules define an exterior passageway between the first module and the second module;

the exterior fluid passageway defines a second longitudinal flow path;

the exterior passageway is in fluid communication with the lateral fluid channel and the internal fluid passageway; and the link slab is supported by the second module with the top slab surface being flush with the first and second top deck surfaces.

7. The assembly of claim 6, wherein the exterior fluid passageway has a top portion adjacent an underside of the link slab and a bottom portion adjacent the respective bottom edge of the first sidewalls of the first and second module, the exterior fluid passageway having a tapered configuration which narrows as it extends from the top portion to the bottom portion.

8. The assembly of claim 1 further comprising a leg integrally formed with and extending downward from the link slab.

9. A modular assembly for managing the flow of fluid beneath a ground surface, the assembly comprising:

a plurality of precast concrete modules each comprising a deck portion comprising a top deck surface, opposing spaced-apart sidewalls integrally formed with and extending downward from opposing longitudinal side edges of the deck portion to respective bottom edges, at least one open end, and at least one shoulder extending outward from the opposing spaced-apart sidewalls, the opposing spaced-apart sidewalls sloping outward and away from one another as they extend downward from the first deck portion to the respective bottom edges;

a plurality of link slabs each supported by the at least one shoulder and comprising a top slab surface;

an inlet port; and an outlet port;

wherein:

each module comprises an interior fluid passageway, which defines a longitudinal flow path, the interior fluid passageway being defined by an underside of the deck portion and an interior surface of the opposing spaced-apart sidewalls, the interior fluid passageway having a top portion adjacent the underside of the deck portion and a bottom portion adjacent the respective bottom edges of the opposing sidewalls, the interior fluid passageway having a flared configuration which widens as it extends from the top portion to the bottom portion;

at least some of the modules comprising a lateral fluid passageway which defines a lateral flow path, the lateral fluid passageway being defined by lateral openings extending through the opposing sidewalls of the at least some of the modules, the lateral fluid passageway being in fluid commination with the interior fluid passageway;

a first predefined number of the plurality of modules arranged side-by-side to form at least one row in a lateral direction; and a second predefined number of the plurality of modules arranged end-to-end to form at least one column in a longitudinal direction.

10. The assembly of claim 9, wherein the outlet port is smaller than the inlet port.

11. The assembly of claim 9, wherein the inlet port is located in the deck portion of at least one of the plurality of modules.

12. The assembly of claim 9, wherein the outlet port is located in a floor defined by the assembly.

13. The assembly of claim 9 further comprising:

an outer perimeter comprising a plurality of perimeter precast concrete modules and a perimeter wall;

wherein:

each perimeter module comprises a solid external sidewall and an external open end; and the perimeter wall at least partially encloses the external open end of each perimeter module.

14. The assembly of claim 9 wherein the plurality of precast concrete modules is comprised of a hollow core material and prestressed concrete.

15. A method for making a precast concrete module for use in a modular assembly for managing the flow of water beneath a ground surface, the method comprising the steps of:

positioning a bulkhead along a central longitudinal axis defined by a lower portion of a mold, the bulkhead comprising at least two side portions, each side portion defining a bulkhead notched section that defines a seat void to form at least one seat of the module;

rotating at least two opposing arms comprising at least two distal ends to a first position;

supporting a lid on the at least two distal ends;

engaging the at least two opposing arms against the lid;

introducing concrete into a void defined by the bulkhead and the mold;

allowing the concrete to harden;

rotating the at least two opposing arms to a second position; and separating a formed module from the mold.

16. The method of claim 15, wherein the at least two opposing arms define at least one arm notched section that defines at least one shoulder void to form at least one shoulder of the module.

17. The method of claim 16, wherein the at least one arm notched section is aligned with at least one bulkhead notched section defined by at least two side portions of the bulkhead.

18. The method of claim 15, wherein the at least two opposing arms are hingedly secured to the lower portion.

19. The method of claim 15, wherein the step of engaging the at least two opposing arms against the lid comprises engaging the at least two opposing arms against the lid with a fastening device and securing the at least two opposing arms with a plurality of latches.

20. The method of claim 19, wherein the step of rotating the at least two opposing arms to a second position further comprises the step of unfastening the fastening device and releasing the at least two opposing arms from the plurality of latches.

* * * * *